US006540381B1

(12) United States Patent
Douglass, II

(10) Patent No.: US 6,540,381 B1
(45) **Date of Patent: *Apr. 1, 2003**

(54) SPECTRAL LIGHT TUBE

(76) Inventor: Myrl Rae Douglass, II, 2726 E. Blanton Dr., Tucson, AZ (US) 85716

( * ) Notice: Subject to any disclaimer, the term of this patent is extended or adjusted under 35 U.S.C. 154(b) by 0 days.

This patent is subject to a terminal disclaimer.

(21) Appl. No.: 09/815,152

(22) Filed: Mar. 22, 2001

Related U.S. Application Data

(63) Continuation-in-part of application No. 09/131,964, filed on Aug. 10, 1998, and a continuation-in-part of application No. 08/735,069, filed on Oct. 18, 1996, now Pat. No. 5,791,775, and a continuation-in-part of application No. 08/934,910, filed on Sep. 22, 1997, now Pat. No. 5,997,151.

(60) Provisional application No. 60/005,742, filed on Oct. 20, 1995, provisional application No. 60/055,473, filed on Aug. 12, 1997, provisional application No. 60/062,715, filed on Oct. 22, 1997, and provisional application No. 60/191,353, filed on Mar. 22, 2000.

(51) Int. Cl.[7] ..... F21V 5/08

(52) U.S. Cl. ..... 362/311; 362/326; 359/567; 359/574

(58) Field of Search ..... 362/311, 326, 362/351; 359/570, 567, 566, 571, 572, 573, 574, 575

(56) References Cited

U.S. PATENT DOCUMENTS

| | | | | |
|---|---|---|---|---|
| 3,388,246 A | | 6/1968 | Bailey | |
| 4,109,305 A | | 8/1978 | Claussen et al. | |
| 4,256,405 A | | 3/1981 | Fjarlie | |
| 4,716,506 A | | 12/1987 | Shang | |
| 4,799,764 A | | 1/1989 | Crowell | |
| 4,837,667 A | | 6/1989 | Grau | |
| 4,843,529 A | | 6/1989 | Izenour | |
| 4,882,661 A | | 11/1989 | Arnaud | |
| 5,077,645 A | | 12/1991 | Habinak | |
| 5,089,946 A | | 2/1992 | Mayer et al. | |
| 5,247,491 A | | 9/1993 | Kwiatkowski | |
| 5,339,225 A | * | 8/1994 | Wiggerman | 362/477 |
| 5,347,431 A | | 9/1994 | Blackwell et al. | |
| 5,440,469 A | | 8/1995 | Gomes | |
| 5,455,754 A | | 10/1995 | Hoffner | |
| 5,517,391 A | | 5/1996 | Grau | |
| 5,644,565 A | | 7/1997 | Toda et al. | |
| 5,672,003 A | | 9/1997 | Shemitz et al. | |
| D391,653 S | * | 3/1998 | Ford | |
| 5,791,775 A | | 8/1998 | Douglass, II | |
| 5,997,151 A | | 12/1999 | Douglass, II | |
| 6,011,650 A | | 1/2000 | Parker et al. | |

FOREIGN PATENT DOCUMENTS

| | | | |
|---|---|---|---|
| JP | 405002148 | * | 1/1993 |

* cited by examiner

*Primary Examiner*—Sandra O'Shea
*Assistant Examiner*—Hargobind S. Sawhney
(74) *Attorney, Agent, or Firm*—Garvey, Smith, Nehrbass & Doody, L.L.C.; Seth M. Nehrbass

(57) ABSTRACT

A tube has walls consisting totally or partially of a first diffraction grating with its ruled surface aligned perpendicular to the length of the tube to disperse a field of rainbow colored light when illuminated with a light source aimed through or along the length of the tube.

37 Claims, 30 Drawing Sheets

SPECTRAL LIGHT TUBE

CROSS-REFERENCE TO RELATED APPLICATIONS

This application is a continuation-in-part of U.S. patent application Ser. No. 09/131,964 filed Aug. 10, 1998, U.S. patent application Ser. No. 08/735,069, filed Oct. 18, 1996 now U.S. Pat. No. 5,791,775, and U.S. patent application Ser. No. 08/934,910, filed Sep. 22, 1997 now U.S. Pat. No. 5,997,151, are incorporated herein by reference. Also incorporated herein by reference are U.S. Provisional Patent Application Serial No. 60/005,742, filed Oct. 20, 1995, U.S. Provisional Patent Application Serial No. 60/055,473, filed Aug. 12, 1997, and U.S. Provisional Patent Application Serial No. 60/062,715, filed Oct. 22, 1997.

Also incorporated herein by reference is my U.S. Provisional Patent Application Serial No. 60/191,353, filed Mar. 22, 2000, priority of which is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to decorative lighting fixtures and to reflectors and filters for lights.

2. General Background of the Invention

Colored lighting has been used for centuries to convey moods and create special theatrical effects. Most colored light has been created by passing light through either colored gels, dichroic filters, or oil membranes. In either case the resulting color of light has been dependent on the color of the filter, or substance the light passes through. Diffraction gratings have been used in small scale optical displays that use combinations of light sources and light manipulating devices, to produce a variety of pleasing color effects. Due to the difficulty in keeping the polychromatic (undiffracted) light from interfering from the monochromatic (diffracted) light, most applications, especially those utilized by the lighting industry, have been quite limited in scope.

An example of a decorative optical display apparatus that employs a diffraction grating is U.S. Pat. No. 6,011,650 to Parker; William P. (hereinafter "the 650 patent"). Discloses a decorative optical display utilizing a reflective diffraction grating or a transmissive diffraction grating and a plurality of polychromatic light sources disposed around perimeter of the reflective diffraction grating or perimeter of the transmissive diffraction grating. The light sources are disposed so as to the illuminate the reflective or transmissive diffraction grating at an oblique angle, respectively. The oblique illumination of the reflective or transmissive diffraction grating prevents a viewer from seeing undiffracted light rays or emanating from the light sources, which can detract from the appeal of the optical display pattern. The reflective or transmissive diffraction grating may be flat or curved and may be supported by a support member. Further, the reflective or transmissive diffraction grating may have either a single or multiple axes. A shade is provided to cover the light sources to prevent undiffracted light rays from reaching the viewer, or to hide wires connecting the light sources. Also, the activation of the light sources is controlled via a control unit, and can be set to any one of a number of different temporal and spatial activation modes. The optical display is also adaptable for a variety of uses calling for an attractive display, such as a clock or a display sign.

An example of a lighting fixture or lamp that employs a diffraction grating is U.S. Pat. No. 4,716,506 to Shang; Hui C. (hereinafter "the 506 patent"). The 506 patent discloses an iris-producing lamp device comprising one or more non-monochromatic light sources with its socket or sockets mounted on bracket. A paraboloid mirror may be disposed behind each lamp socket and a light source in the focus of the paraboloid mirror and the lamp shade is made of a grating-film iris-producing glass with a non-monochromatic light source in it. Thus the lamp shade can reflect not only its original color but also the other colors when the lamp is shut-off while transmitting a variety of colorful patterns and projecting them to objects around the lamp device when the lamp is on.

While the optical display of the 650 patent does describe a way to display colored light patterns consisting of diffracted light that are not overpowered by the undiffracted light from the light source, it has several major limitations if it is to be used as a source of decorative illumination. The major limitation is that the display is basically contained within a flat panel and is designed to be viewed from one side only. Most decorative lighting fixtures are meant to be viewed from many angles. The other limitation is that the diffracted light created by the device is too weak to be projected over any distance because the multiple axial nature of the device weakens the clarity and strength of the diffracted light. The single axial nature of the light tube intensifies the clarity and strength of the display to the point that it envelopes the surrounding space with projected, prismatic light, whereas the 650 patent is not meant to illuminate its surroundings, but is designed as a pure display.

The third limitation is that motion and change to the display is achieved with an electronic means, whereas with the light tube, the color effect changes with the position of the viewer.

While the 506 patent does disclose a lamp that creates color with a diffraction grating and is bright enough to illuminate the surrounding space, it also has some major drawbacks. The first is that it is not always desirable to view undiffracted light through the transmissive grating because the undiffracted light tends to overwhelm the diffracted light. The second is that the interference created by the undiffracted light makes the projection of clear diffracted light nearly nonexistent.

The following U.S. Patents (and all references mentioned therein) are incorporated herein by reference: U.S. Pat. Nos. 3,388,246; 4,799,764; 4,109,305; 4,256,405; 4,716,506; 4,837,667; 4,843,529; 4,882,661; 5,077,645; 5,089,946; 5,247,491; 5,347,431; 5,440,469; 5,455,754; 5,517,391; 5,644,565; 5,672,003; 5,791,775; 5,997,151; 6,011,650.

BRIEF SUMMARY OF THE INVENTION

The present invention relates to decorative lighting and may have broader applications as used in signage, a decorative sculptural element, or for instrumentation and navigation systems. The Spectral Light Tube produces a rainbow colored light field that appears to emanate from the central hollow shaft inside of the tube when illuminated with a light-source directed through the center of the tube. The invention includes a diffraction grating that is curved into an approximately cylindrical or tubular structure and one or multiple light sources that direct light through the open axis of the tubular structure. The light sources illuminate the grating at an oblique angle so that diffracted (monochromatic light) is projected on an axis perpendicular to the surface of the diffraction grating. Since the diffracted light is projected roughly perpendicular to the axis of the light source, it is not overpowered by the light source. Since the surface of the grating is formed into a tubular structure around the axis formed by the light emanating from the light source, the diffracted light is projected (in a radial pattern around) (from all sides of) that axis. The diffraction grating may be reflective or transmissive. A transmissive grating can either be mounted or molded onto the surface of a transparent or translucent support surface. The tube may be made with a reflective grating in a manner that allows some light to pass through its aggregate structure:

1. A reflective grating may be mounted or molded into the inside surface of any material, and then perforated to create a semi transparent support surface.
2. Pieces of a reflective diffraction grating may be mounted onto the inside surface of a transparent or translucent support surface so that the gaps between the pieces allow light to be transmitted through them.
3. A reflective grating may be mounted or molded into the inside surface of any material that is then cut into strips and woven into a tubular structure that allows light to pass through the open gaps of the weave.
4. A reflective grating may be mounted or molded into the surface of any material that is then assembled as a piece to an aggregate tubular structure that allows light to pass through the open gaps between the pieces.

The cross sectional shape of the tube may be circular or varied to create different lighting effects and to focus the color displays into certain directions. The walls of the tube may either be parallel, or slightly bowed or angled to each other to create other variations to the lighting effect.

Due to the linear nature of the Tube, the geometry of the spectral optics allows for great variations to the color display that are determined by the angle and distance that the tube is viewed from. This effect not only has a dynamic and engaging quality that has appeal for the decorative lighting market, but it could also be used in navigation and instrumentation, as a positioning device.

It has also been discovered that by passing water over the surface of the light tube, dynamic variations to the color effect are created. The refraction of light by the moving water surface constantly changes the angle of incidence of the diffracted light rays. Since the incidence angle effects the color of the light ray, the colors are altered by the surface pattern of the water flow.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
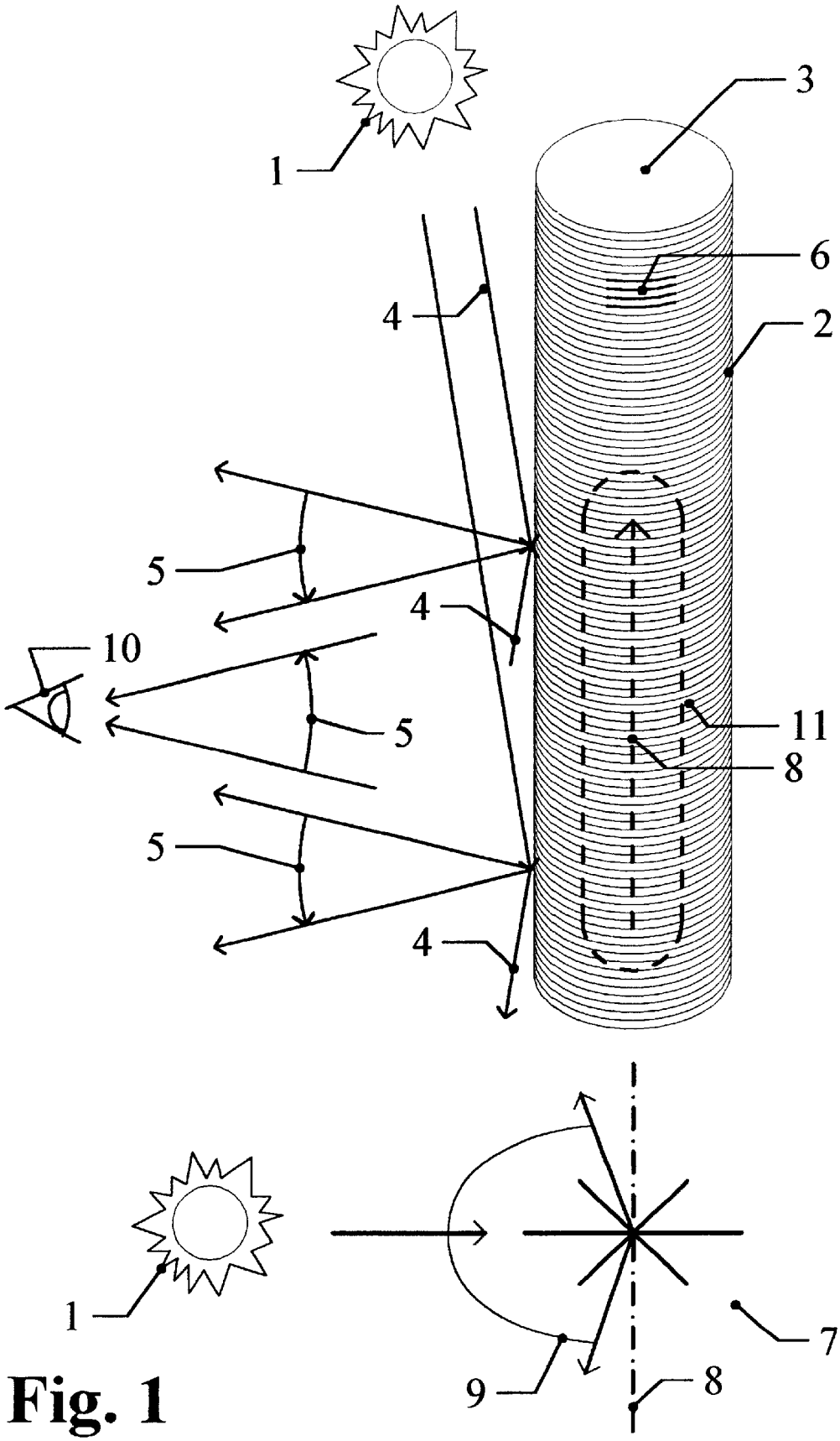
FIG. 1 is an axonometric view of a Spectral Light Rod taken from a previous invention by the inventor.

The Spectral Light Tube is a direct development form a previous invention by Rae Douglass wherein the surface of a reflective diffraction grating is curved into a tubular structure so that the microscopic grooves of the grating are aligned perpendicular to the length of the tube to produce a similar effect to neon tubing, when illuminated with a remote light source. FIG. 1 describes the basic components and principles of this invention. A reflective diffraction grating film 2 is wrapped onto the curved surface of a solid cylindrical support rod 3. The microscopic grooves of the grating 6, are aligned in a radial pattern that is perpendicular to the length of the rod. The tubular diffraction surface is aligned so that the length of the tube is at an oblique angle to a non-diffuse light source 1, such as a spot light, or the sun. The Polychromatic (white) light 4, produced form that light source hits the surface of the grating and is dispersed into diffracted light 5, that in a direction that is roughly perpendicular to the length of the rod. Since the rod is circular in cross section, the diffracted light emanates in a radial pattern 7, that is aligned with the center of the tube 8. When viewed by an observer 10, the radial pattern 7, allows the diffracted light to be visible at a wide range of angles 9, from the center of the tube 8, and centered on the angle of the light source. If the grating surface was flat the diffracted light would not be visible from as many angles. The circular cross section of the tube situates the surface of the diffraction grating so the portion of the grating at the middle of the tube is always in optimal alignment to the observer in that axis. The optimal alignment intensifies the visible color display 11, along the center of the tubes length, to the point that it resembles a highly charged neon tube, and gives the effect that the light is emanating from the center and not the surface of the solid rod.

Figure 2:
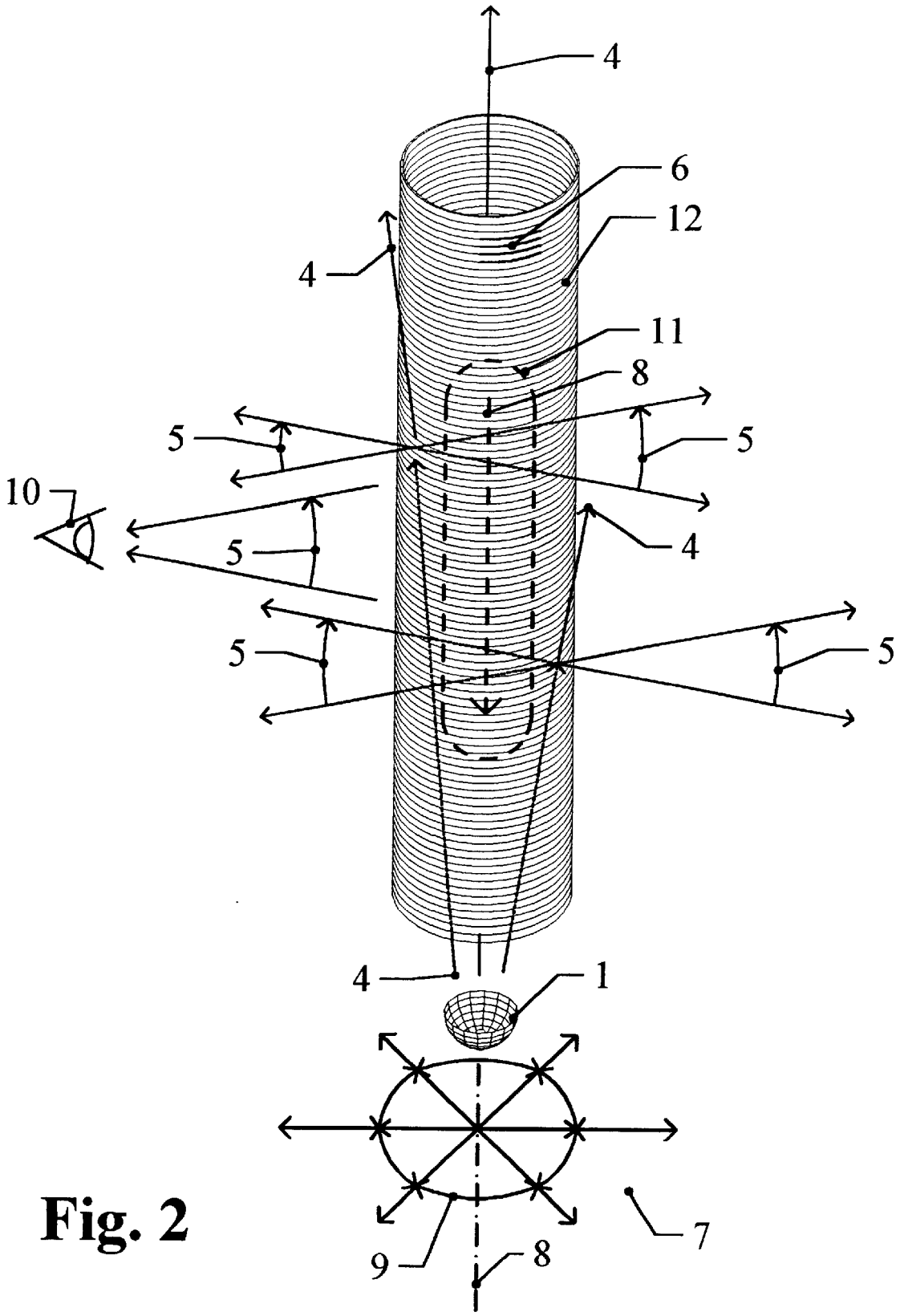
FIG. 2 is a an axonometric view of a Spectral Light Tube showing the basic components of the system of the present invention.

The Spectral Light Tube is similar to the Spectral Light Rod, but the tube is hollow, and the light source is directed through the hollow length of the tube, instead of from the outside of the rod. FIG. 2 describes the basic components and principles of this invention. A diffraction grating 12, is wrapped onto a tubular shape. The microscopic grooves of the grating 6, are aligned in a radial pattern that are perpendicular to the length of the tube. A non-diffuse light source 1, such as a spot light, or the sun, is aligned to project light through the center of the tube. The Polychromatic (white) light 4, produced form that light source hits the surface of the grating at an oblique angle and is dispersed into diffracted light 5, that in a direction that is roughly perpendicular to the length of the tube. Since the tube is circular in cross section, the diffracted light emanates in a radial pattern 7, that is aligned with the center of the tube 8. When viewed by an observer 10, the radial pattern 7, allows the diffracted light to be visible at all angles 9, from the center of the tube 8. The Spectral Light Tube has the advantage over the Light Rod, in that the color display is visible from all angles around the sides of the tube, and not limited to the side that also has the light source. Like the Light Rod, the circular cross section of the tube situates the surface of the diffraction grating so the portion of the grating at the middle of the tube is always in optimal alignment to the observer in that axis. The optimal alignment intensifies the visible color display 11, along the center of the tubes length, to the point that it resembles a highly charged neon tube, and gives the effect that the light is emanating from the center and not the surface of the tube.

Figure 3:
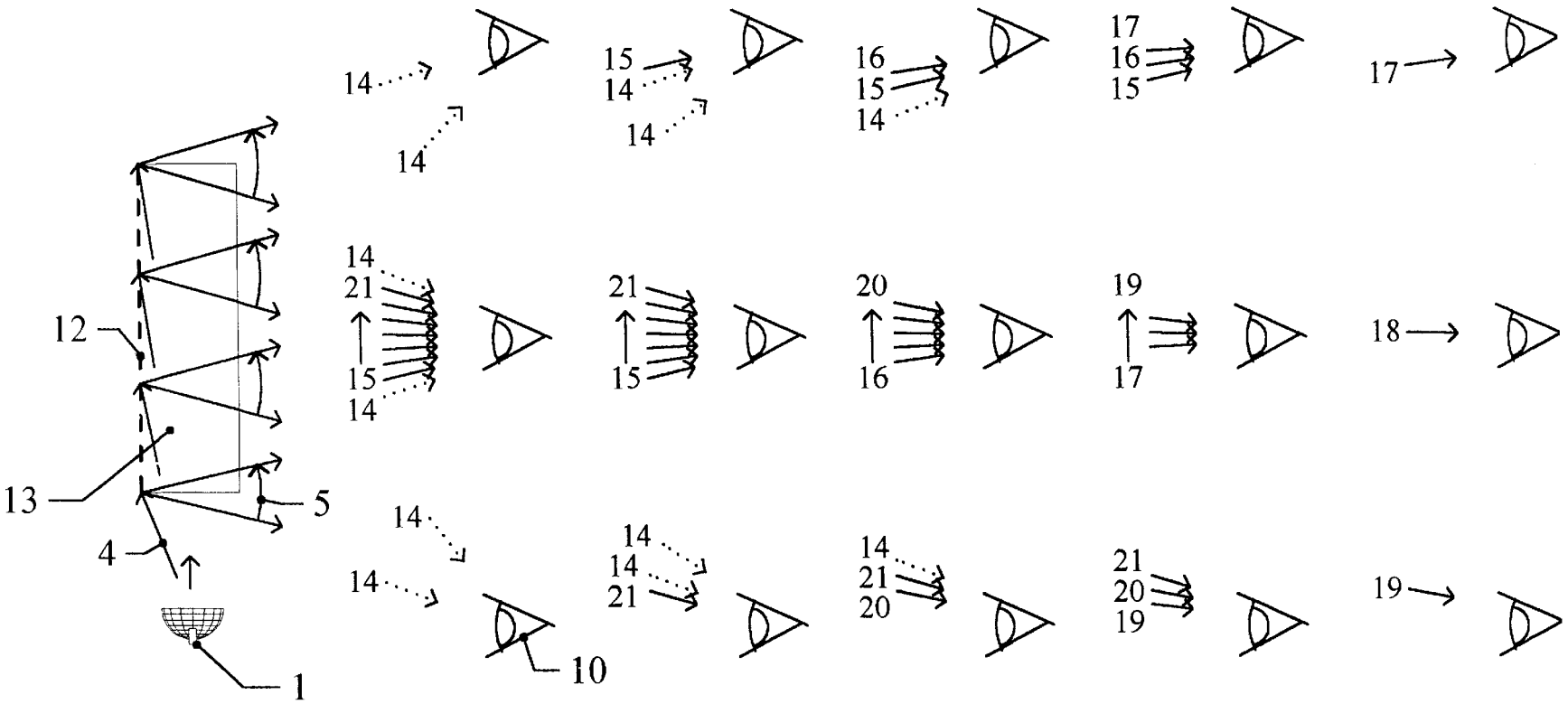
FIG. 3 is a diagrammatic section showing how the optical principles of how the position of the viewer alters the perceived color effect.

FIG. 3 shows how the color display of the light tube varies with the position that it is viewed from. When the observer 10, is relatively close and centered with the side of the light tube 13, the full spectrum of color 15–21, is visible displayed within the length of the light tube. As the observer moves away from the tube the color display broadens along the tube, so that only a few colors, and finally a single color 18, displayed along the length of the tube. If the observer is relatively perpendicular with the center of the tube, green 18, is the predominant color. If the observer shifts to either side the color shifts towards red 21, or violet 15, respectively. If the observer moves too far to either side all he sees is white light 14. When used for decorative purposes, the display has a dynamic and interactive quality, and when used for utilitarian purposes it can be used as an alignment and positioning system for navigation. The light tube could be used in tandem with the taillights of an automobile to assist motorist to know how close they are following each other at night and in poor visibility. The tube could also be used in a much larger scale to assist pilots in their final approach to the runway.

Figure 4:
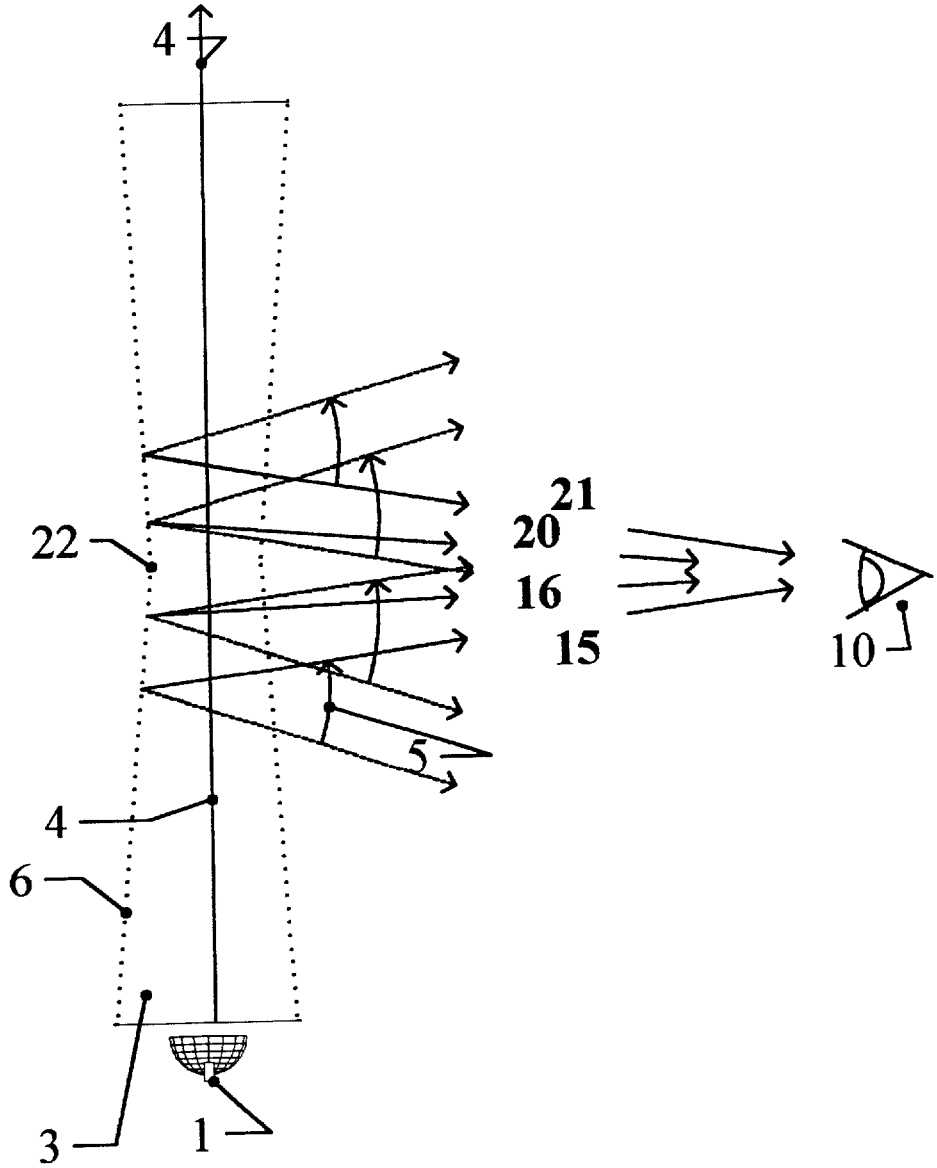
FIGS. 4–6 are diagrammatic sections describing how changing the alignment of the walls of the tubular structure alters the perceived color effect.
Figure 5:
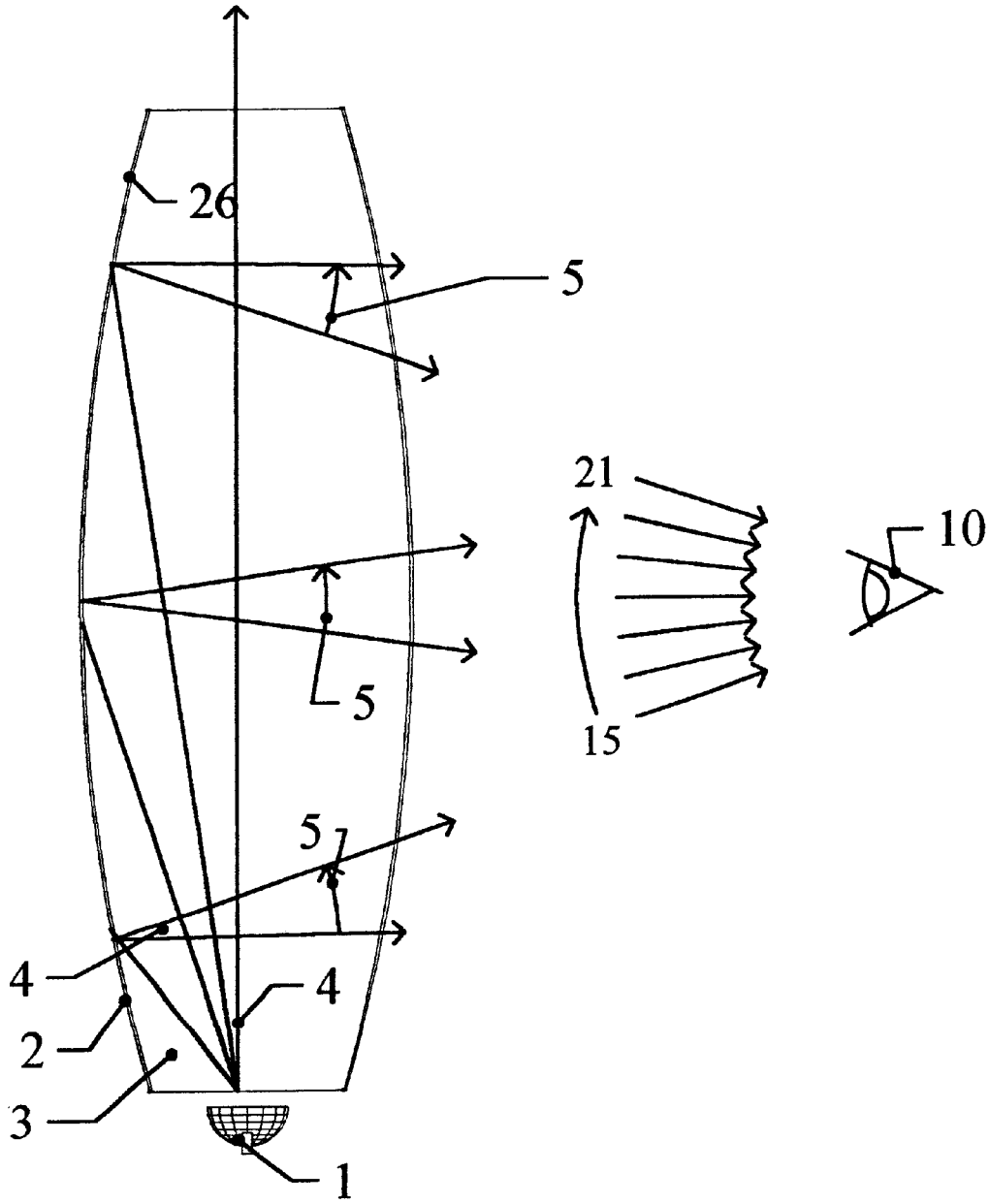
Figure 6:
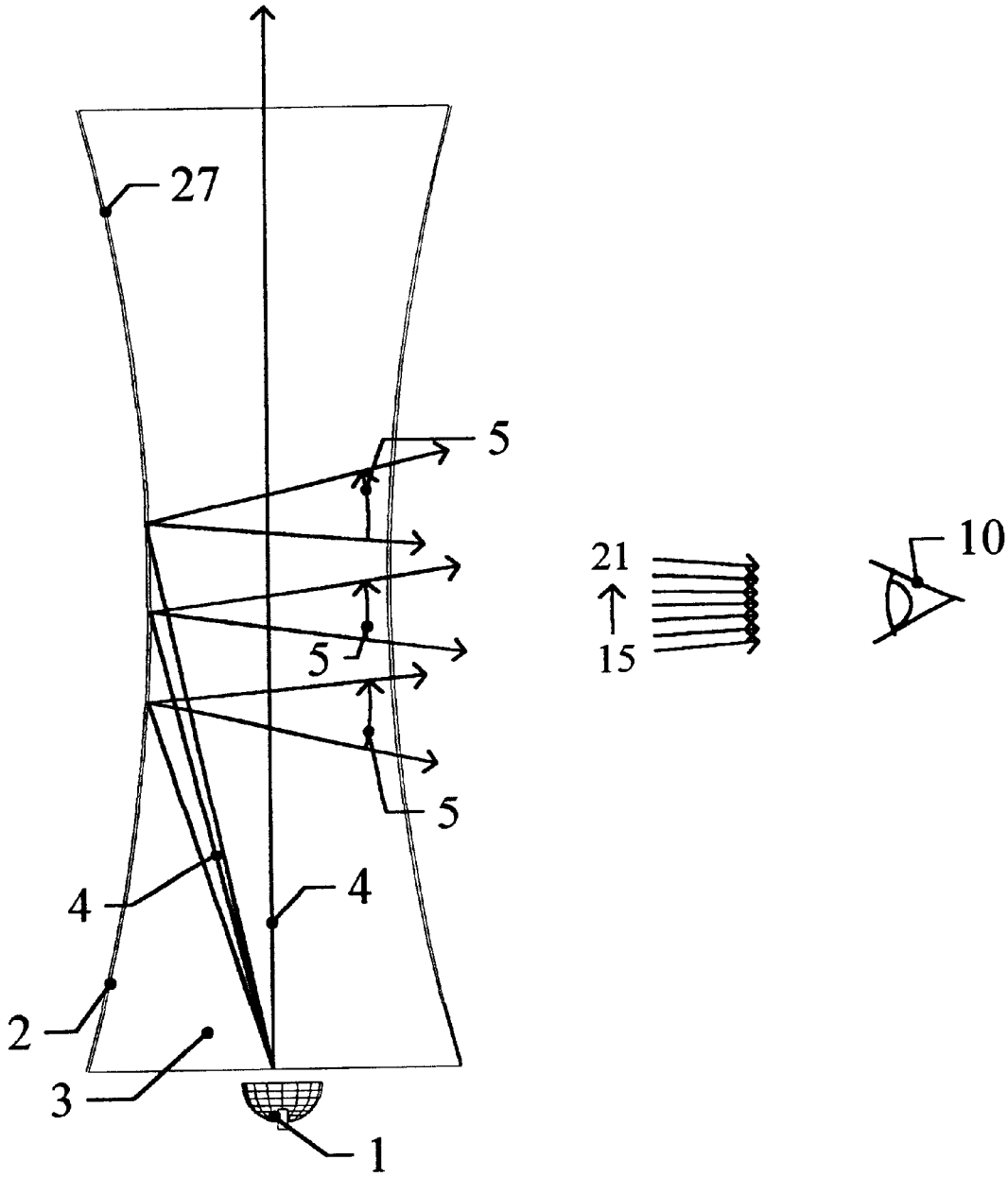
Figure 8:
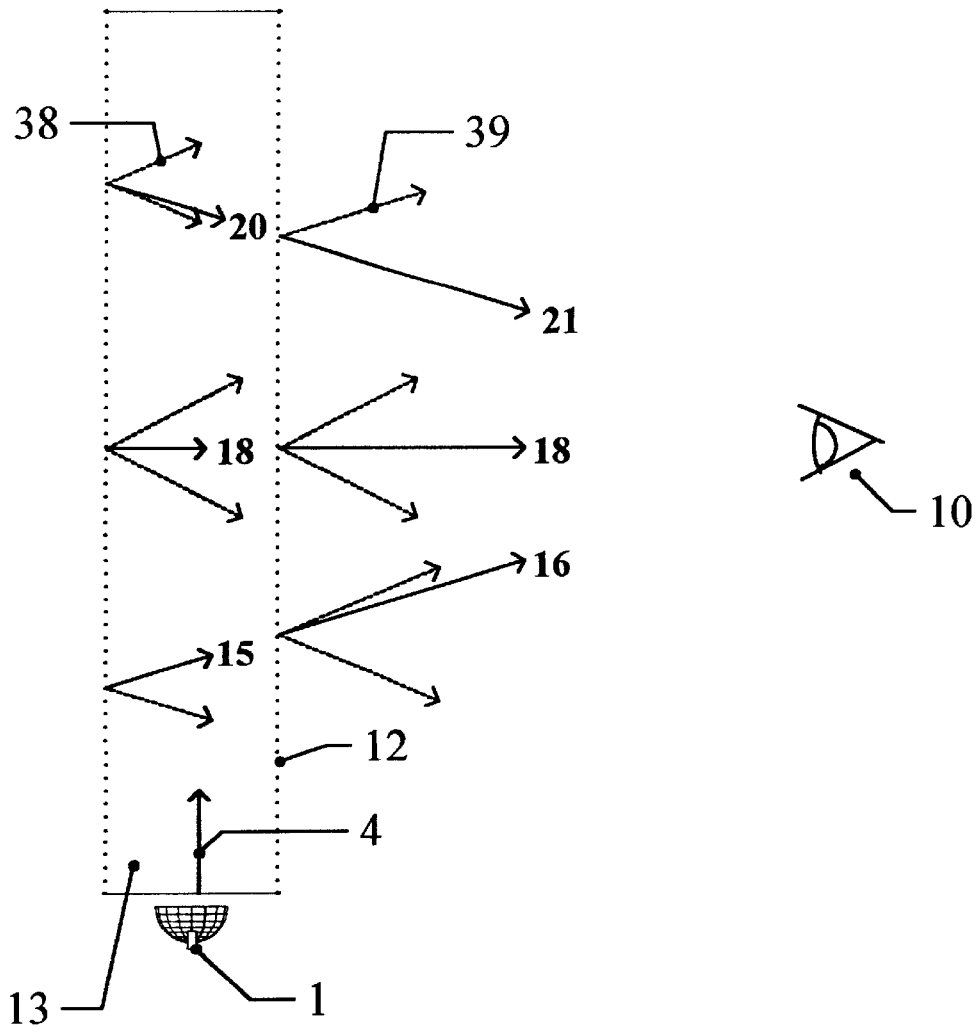
FIGS. 8 and 9 are diagrammatic sections showing the optical properties of using either a transmissive or reflective diffraction grating.

When the walls of the light tube are straight and parallel to each other as shown in the previous examples, the color display has a consistent and smooth display of color in the correct spectral order. FIG. 4 shows a variation of the light tube where the walls are bent 22, at slight angles and are not parallel to each other. The angled walls can provide variations to the order that the colors are perceived, and provide areas along the length of the tube 24, where the sequence of colors is altered, such as in FIG. 4 where the display jumps from indigo 16, to orange 20. This effect works best with a reflective grating, because a transmissive grating disperses diffracted light from both sides of its surface. With a transmissive grating both walls of the tube generate color displays that are simultaneously visible from the same side of the tube. When the walls of the tube are parallel this effect is not problematic because the angles of incidence for each wall are approximately the same in relation to the viewer, so the overlapping diffracted light rays reinforce each other. FIG. 8 describes this in more detail. When the walls are angled to each other, the angles of incidence are not the same in relation to the viewer, so the overlapping diffracted light rays interfere with each other and degrade the color effect. The walls of the tube can also be curved, as shown in FIGS. 5 and 6. Curving the walls has the same effect that bending the walls has on use of a transmissive grating, so a reflective grating also works best for these variations. FIG. 5. shows the optical properties of curving the walls out from each other. The concave curve to the diffraction surface 26, causes the diffracted orders 5, to angle into one another. The resulting effect is that the band of colors visible along the length of the tube 15–21 is much longer and appears to fill up much more of the length of the tube than the effect created by a tube with parallel walls. The effect is works best if a display of only a few colors is desirable. It is also desirable for lamps that are to be mounted above and below eye level, because it increases the vertical range that colors can be seen from. FIG. 6 shows the optical properties of curving the walls into each other. The convex curve to the diffraction surface 27, causes the diffracted orders 5, to angle away from one another. The resulting effect is that the band of colors visible along the length of the tube 15–21 is much shorter and appears to fill up much less of the length of the tube than the effect created by a tube with parallel walls. The effect is works best if a display of all the colors of the spectrum are desirable from many vantage points.

Figure 7:
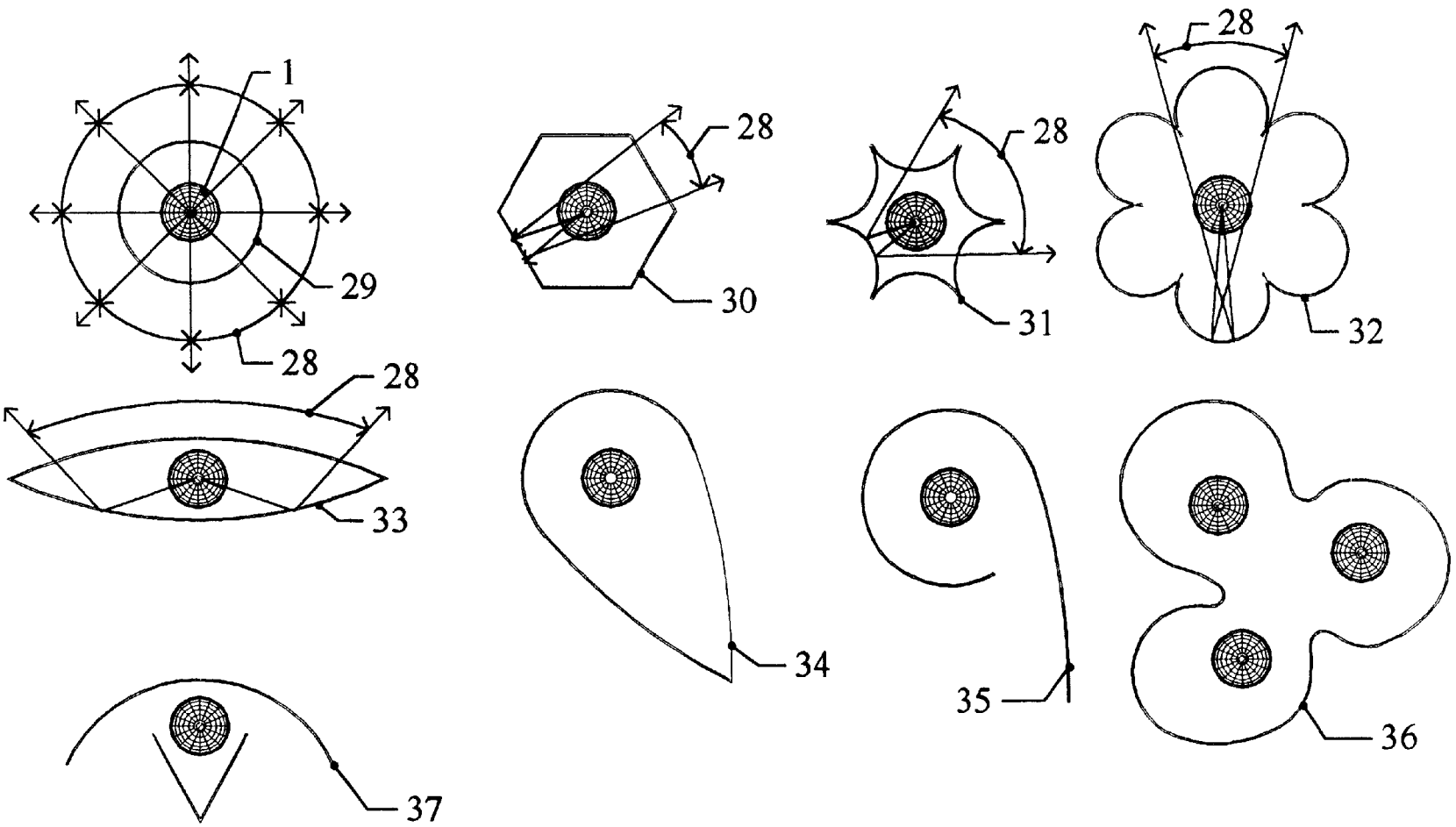
FIG. 7 are diagrammatic plan views describing how changing the cross sectional shape of the tubular structure alters the perceived color effect.

FIG. 7 shows how the cross sectional shape of the tubular diffraction grating may be round or molded into other shapes to vary the way that the diffracted light is projected around the perimeter of the tube. Variations to the shape do not effect the choice of using a transmissive or reflective grating because they are not altering the surface of the grating in its axis of dispersion. All views in FIG. 7 are plan views consisting of a central light source 1, arrows indicating the direction of diffracted light rays 28 (shown as those produced by a reflective grating for simplicity), and the perimeter wall shape of the tubular grating 29–36. The basic shape is a circle 29, that projects diffracted light rays at a full 360 degree spread from the center of the tube. This configuration produces an effect closest to that of a neon tube, and insures that the portion of the grating at the middle of the tube is always in optimal alignment from any side of the tube. The round shape permits the rainbow effects to be visible from any angle, but the width of the display is relatively narrow. This shape lends itself to applications in signage and other more utilitarian purposes such as navigation. A faceted shape 30, displays the rainbow effects most vividly from a vantage point perpendicular to each facet, so there are some angles where the display is not that apparent. The faceted shape does permit a wider display, that can be as wide as each facet, but is never quite as intense of a display because it is nearly impossible for the viewer to be align at a point that is exactly perpendicular to the face of the diffraction surface. The facets can be curved as shown in shape 31 and 32. Curved facets can give the effect of multiple circular tubes, but the intensity level is only as great as the circular tube at the point where the axis of the white light is perpendicular to the face of the facet. The circle can also be flattened into an oval, lens, or other oblong shape as shown in shape 33. This configuration presents a broad display of color from the two broad sides of the shape. It also presents some interesting effects when viewed from the narrow sides because the very oblique angles of incidence allow for the higher orders of diffracted light to become visible. The oblong shapes may be used for signage and illuminated mural effects. They may also be used as a screen or room divider. Asymmetrical shapes such as shape 34 can combine the effects of other shapes such as in this case, the circle 29, and the lens 33. In some instances the shape can be asymmetrical and open ended, as in the spiral of shape 35. This can be desirable for certain aesthetic effects. Free form shapes can be used with both single and multiple light sources, as indicated in shape 36 to increase to number of aesthetic variations. Parts of dissimilar shapes can also be used together to create an aggregate tubular structure around the light source, as shown in shape 37. Here, the leg of an equilateral triangle is used with a segment of a circle to surround the light source. The one common trait that all of the shapes of FIG. 7 share is that they all surround the axis of a light source with a diffraction grating oriented with its ruled surface perpendicular to that axis.

Figure 9:
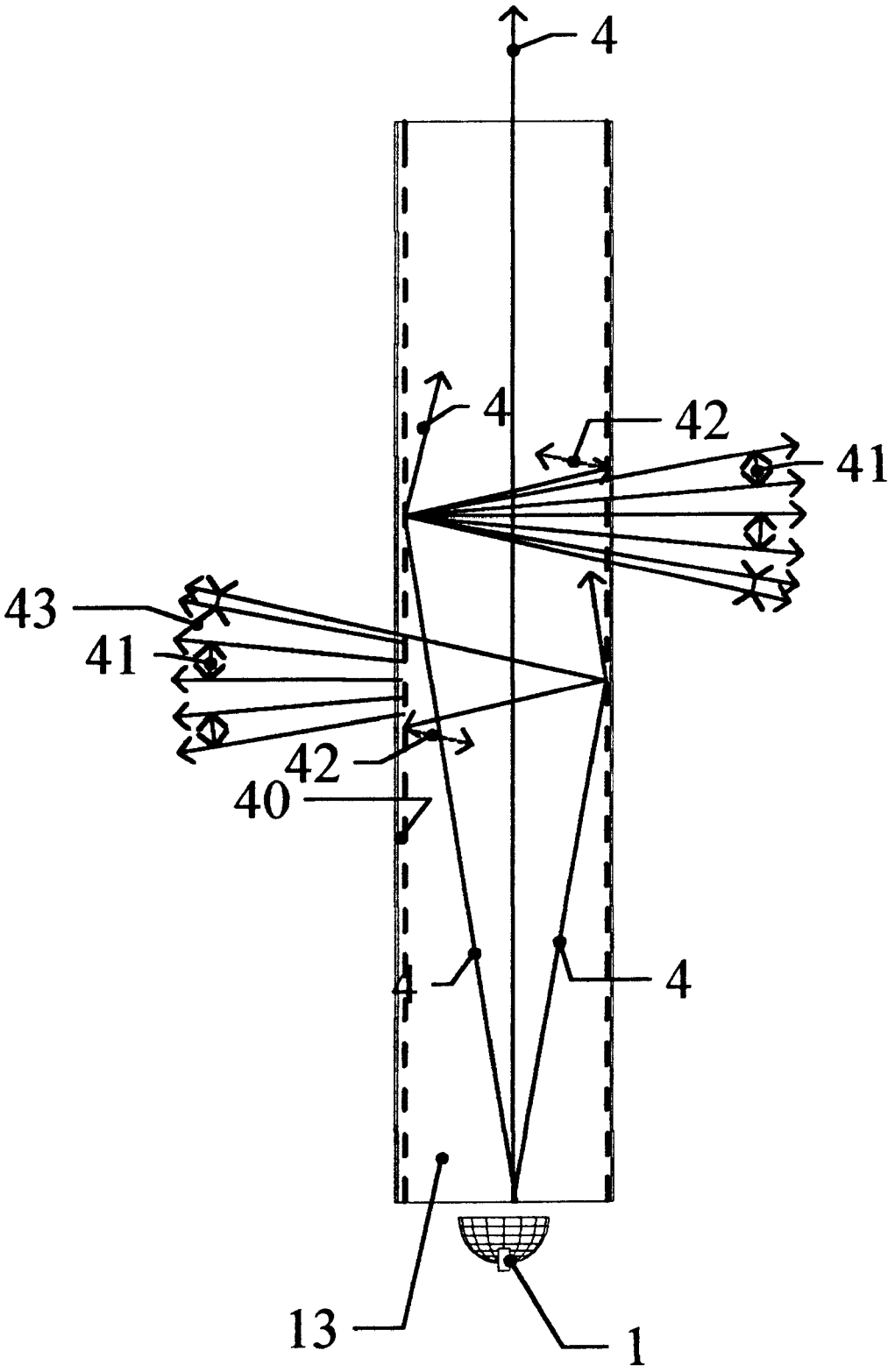

The diffraction grating may be reflective or transmissive. FIGS. 8 and 9 describe the relative benefits and drawbacks of using either a transmissive or reflective grating. A transmissive grating can either be mounted, molded, etched (with a laser), or ruled onto the surface of a transparent or translucent support surface. In a transmissive grating 12, as shown in FIG. 8, diffracted light is dispersed from both the inside 38, and outside 39, of the tubular grating 12. The inside 38, and outside 39 diffracted light rays are seen simultaneously by the viewer, and overlap each other. The overlapping light rays enhance the effect that the color field is not emanating from the surface of the grating, but gives a 3 dimensional depth to the display and makes it appear as if it is suspended within the center of the tube. Since the angle of dispersion 43, is proportional to the angle that the light source 1, is in relation to the diffraction surface 12, the angle of dispersion increases towards the end of the tube that is opposite to the light source. Because of this property, the angle of incidence for a diffracted light ray of a particular color, varies with its position along the length of the tube. When the viewer observes the portion of the tube that is directly perpendicular to them, the overlapping light rays 18, 18, are both being diffracted with identical angles of incidence, so their particular color is identical. Since their colors are the same they reinforce each other, and intensify the color effect. As the observer shifts their glance away from perpendicular, the colors of the overlapping light rays shift and are no longer identical. In the portion closest to the light source, violet and indigo overlap, and at the opposite end, orange and red. The resulting effect is a gradual decline in the intensity and clarity of the colors at the ends of the spectral order. The violets and reds are not as intense as the blues greens or yellows. The shift of overlapping light rays is greatest at the portion of the tubular grating closest to the light source, and diminishes with distance. For this reason, transmissive gratings display a much richer display when the tubular structure is long and slender.

In a reflective grating 40, as shown in FIG. 9, diffracted light is dispersed from only the inside of the tubular grating. Since the surface of the grating is reflective, it is generally opaque, and will not transmit light like the transparent surface of a transmissive grating. If the surface of the tube is completely covered with the grating, the color and light effects will not transmit out of the tube, and be visible to the observer, so only a portion of the tube may contain the reflective grating surface, as shown with the bold dotted line 40, in FIG. 9. The gaps in the line 40, represent the gaps in the grating surface that allow light rays to pass 41. Although the optical geometry of the reflective grating creates gaps 43, in the color effect, light dispersion is only occurring on one side of the grating surface. There are some overlapping light rays occurring from diffracted light that is being reflected from the grating surface on the opposite tube wall, 42, but they are much weaker and less disruptive than the overlapping rays in the tube made with a transmissive grating. However, the weaker overlapping rays contribute to a similar 3 dimensional effects as the transmissive tube. The color display appears to remains clearer throughout its range because the semi opaque nature of the grating surface acts to baffle more of the white light 4, emanating directly from the light source 1. The gaps in the grating surface can be made in any proportion, depending on the application. The gaps can be made with a fine enough resolution that the viewer is unaware of their presence. With a fine resolution, they act in a similar manner to a pixel on a computer screen, or a ben day dot in a printed publication, to produce a smooth and uniform display.

The tube may be made with a reflective grating in a manner that allows some light to pass through its aggregate structure in the following ways:

1. A reflective grating may be mounted or molded into the inside surface of any material, and then perforated to create a semi transparent support surface. The perforations can be a series of regularly spaced holes, or can be varied to create other effects. The perforations can also be cut into figurative shapes and symbols for use in signage and pictographic applications.
2. Pieces of a reflective diffraction grating may be mounted onto the inside surface of a transparent, translucent, or perforated support surface so that the gaps between the pieces allow light to be transmitted through them. The pieces can be a series of regularly spaced uniform shapes, or can be varied to create other effects. The pieces can also be cut into figurative shapes and symbols for use in signage and pictographic applications.
3. A reflective grating may be mounted or molded into the inside surface of a support material that is then cut into strips and woven into a tubular structure that allows light to pass through the open gaps of the weave. Materials for the support surface can be sheet metal, plastic, glass fiber, and cloth. It is conceivable that the Mylar backing of the reflective diffraction grating could be woven without being mounted to a support surface. The Mylar material does come in a 2 mil thickness.

Figure 18:
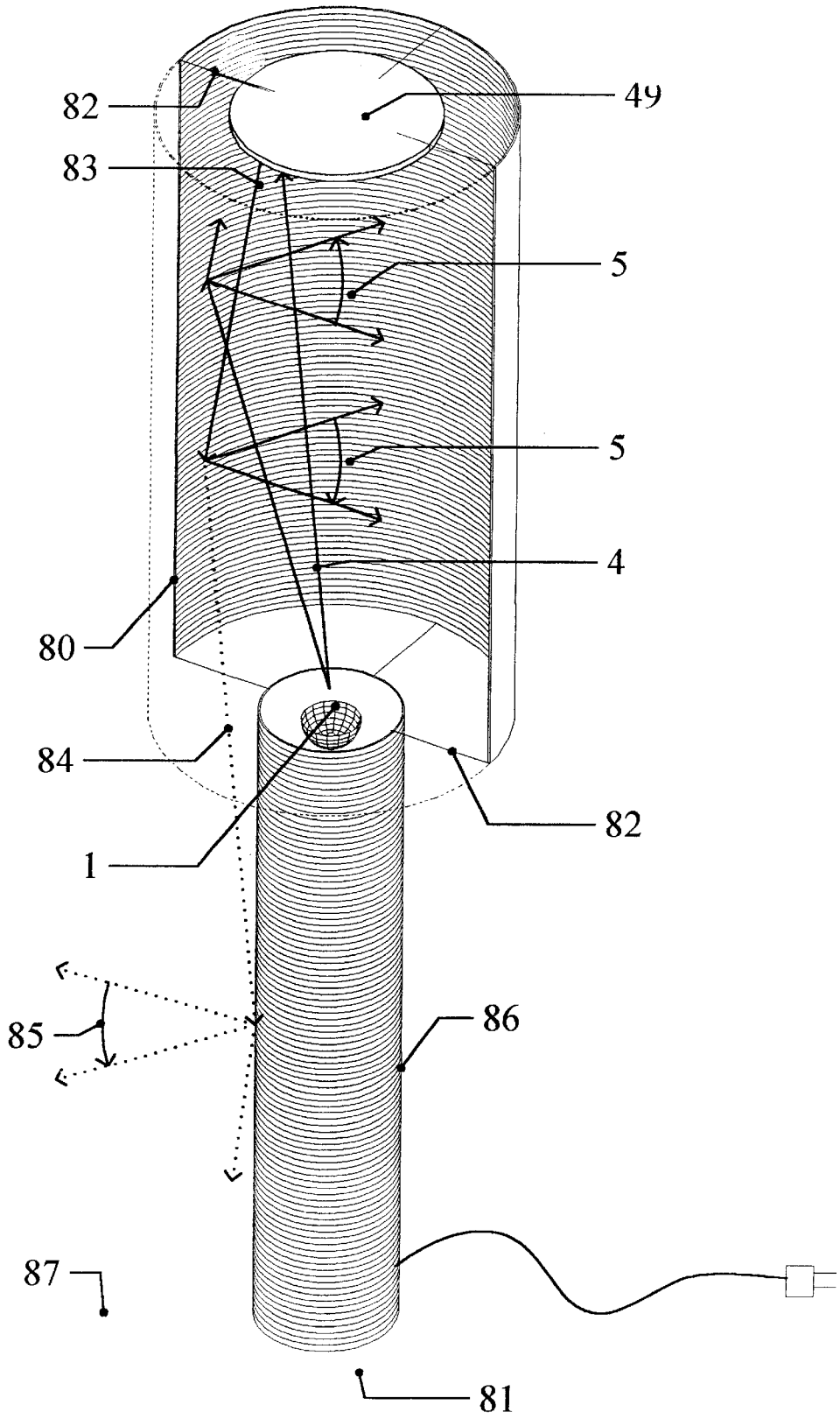
FIG. 18 is a perspective view and sectional view of an embodiment of the invention as a traditional table or floor lamp.

4. A reflective grating may be mounted or molded into the surface of any material that is then assembled as a piece to an aggregate tubular structure that allows light to pass through the open gaps between the pieces. The light tube can be made out of a series of light rods, as shown in FIG. 18, as long as the orientation of the rods is in approximate alignment with the axis of the aggregate tube.

Figure 10:
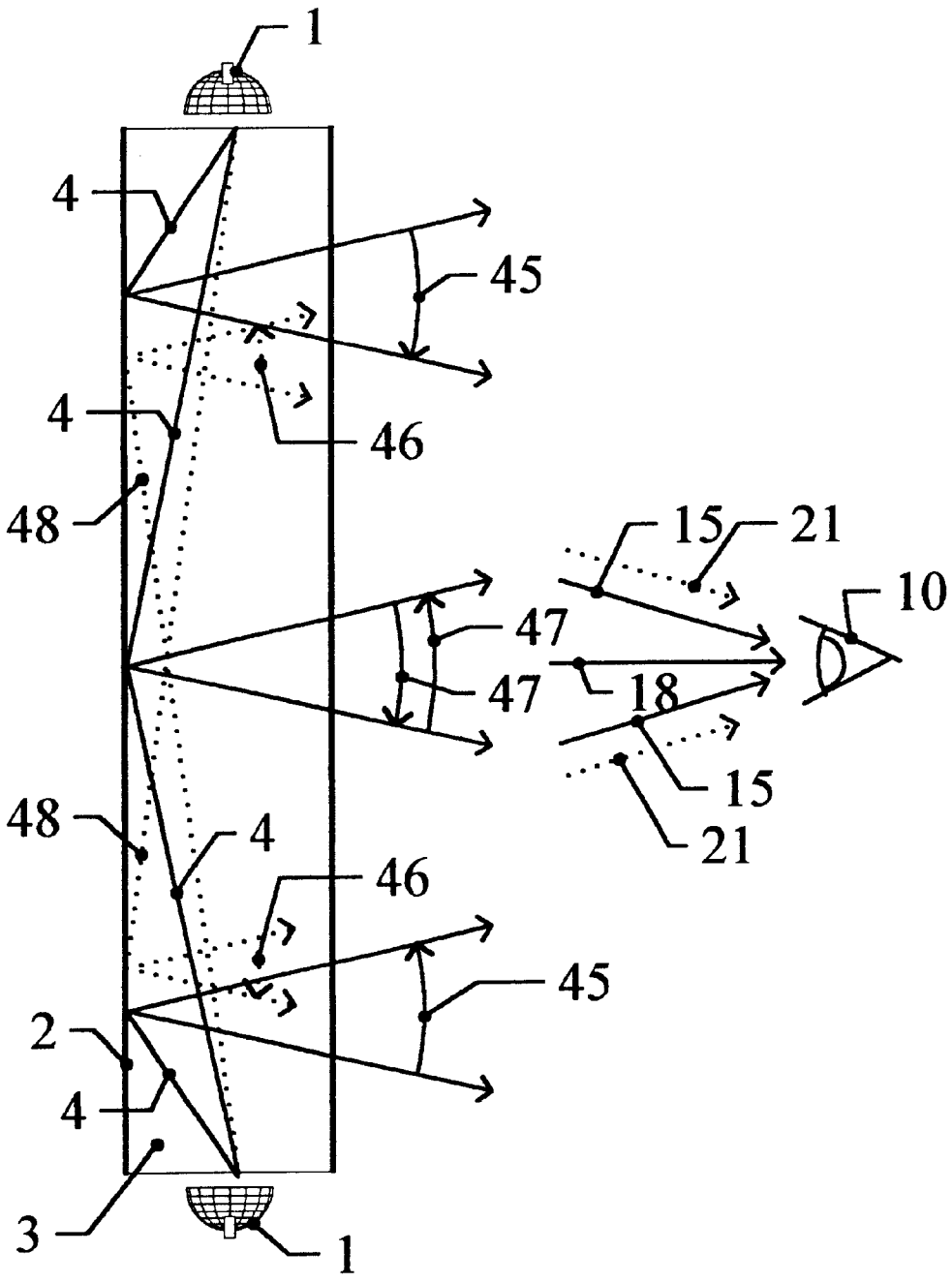
FIGS. 10–12 are diagrammatic sections show how variations to the light source affects the resulting light patterns.
Figure 11:
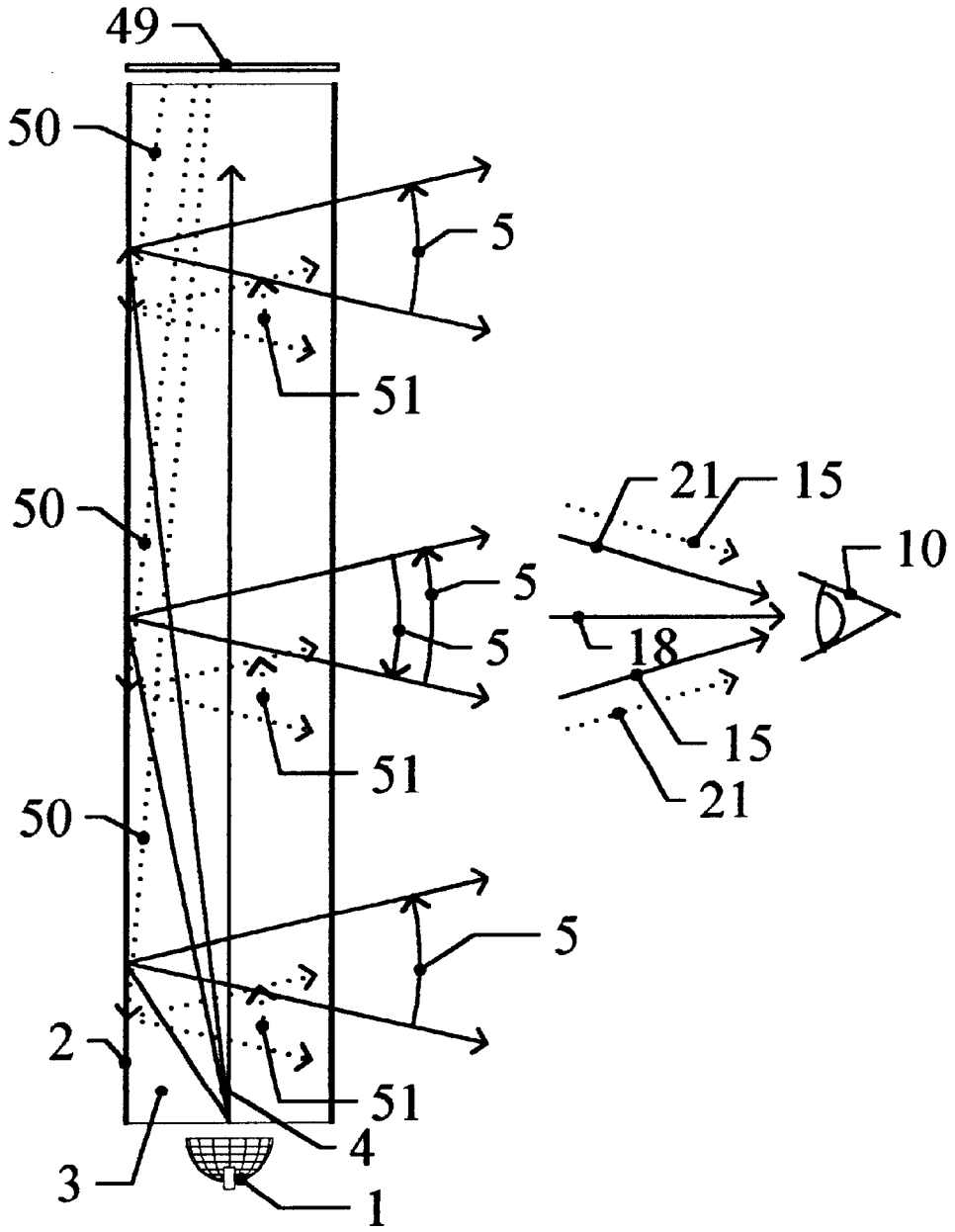
Figure 12:
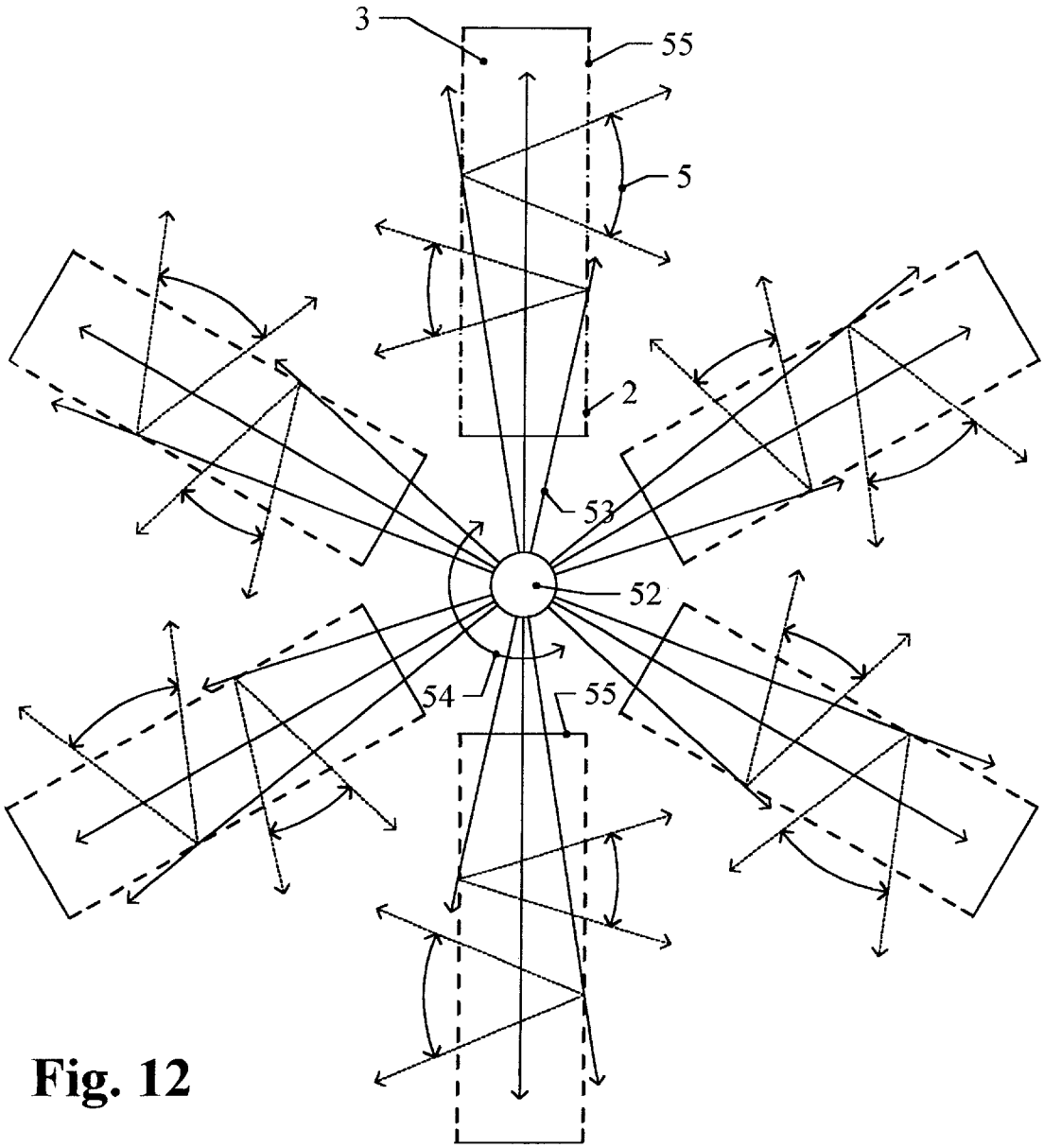

FIGS. 10–12 show some variations to the light source. FIG. 10, shows the optical qualities resulting from placing a light source 1, at both ends of the tube 3. Since the grating surface is simultaneously dispersing diffracted light from both light sources the light rays overlap each other. The light rays being dispersed closest to their light source 45, are stronger than those at the opposite end of the tube 46. When the light rays from each source are seen simultaneously by the observer 10, the stronger rays 45, prevail. The visible colors are no longer displayed in the full spectral range from violet to red, but are displayed from violet 15, to green 18, and then back to violet 15. The light rays in the range from yellow 19, to red 21, are overpowered by the light rays in the range from violet to green, because they are being dispersed from a light source that is further away than the light rays of the violet to green range. This effect is also dependant on the position of the viewer along the length of the tube. The closer viewer moves towards either end of the tube the range of visible colors increases with that proximity. The degradation in color quality due to overlapping light rays is greater with this lighting configuration than with a single light source, because there are two complete sets of overlapping light rays. The display is brighter, but the colors are not as intense at the ends of the spectral range.

FIG. 11, shows the optical qualities resulting from placing a mirror 49, at the opposite end of the tube 3, from the light source 1. The mirror reflects the white light from the light source back into the tube 50, and creates a virtual light source that projects another complete set of overlapping light rays 51. The light reflected from the mirror 50, is not as intense as that being projected directly from the light source 4, so the resulting set of overlapping light rays 51, is not as intense as those being created from the light source 5. As a result, the full range of spectral color 15–21, is visible along the complete length of the tube 3. The mirror keeps more of the light inside of the tube. More light makes the tube appear to be brighter, but there is also a degradation in color quality due to overlapping light rays.

In most of the previous examples a single tube has been illuminated with a single or multiple light sources. FIG. 12, shows an example of a single light source 52, illuminating multiple tubes. The lamp does not have a reflector, so it can throw light 53 in a full 360 degree arc 54. In this arc 54, an array of tubes may be placed so that their open ends 55, align with the center of the light bulb 52. The tubes may be positioned in a two dimensional (circular) array, or a three dimensional (spherical) array.

Figure 13:
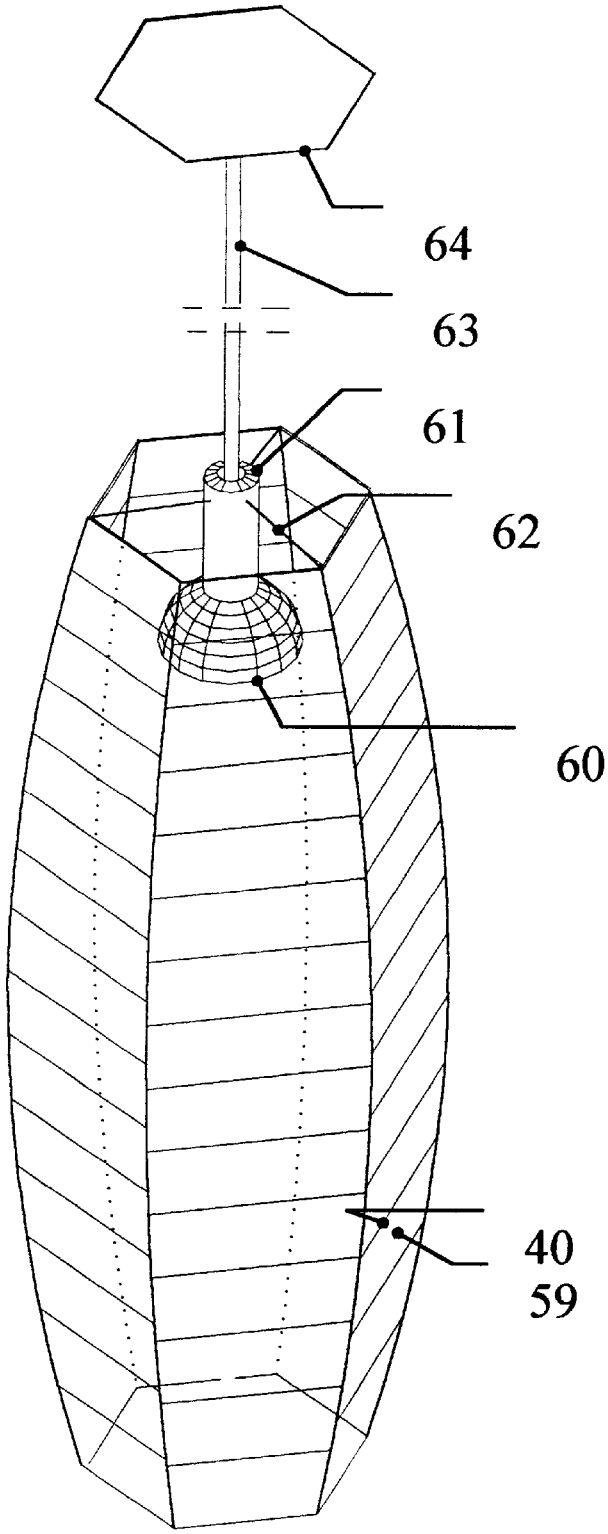
FIG. 13 shows a series of diagrammatic axonometrics showing a range of varieties to the basic tube shape.
Figure 14:
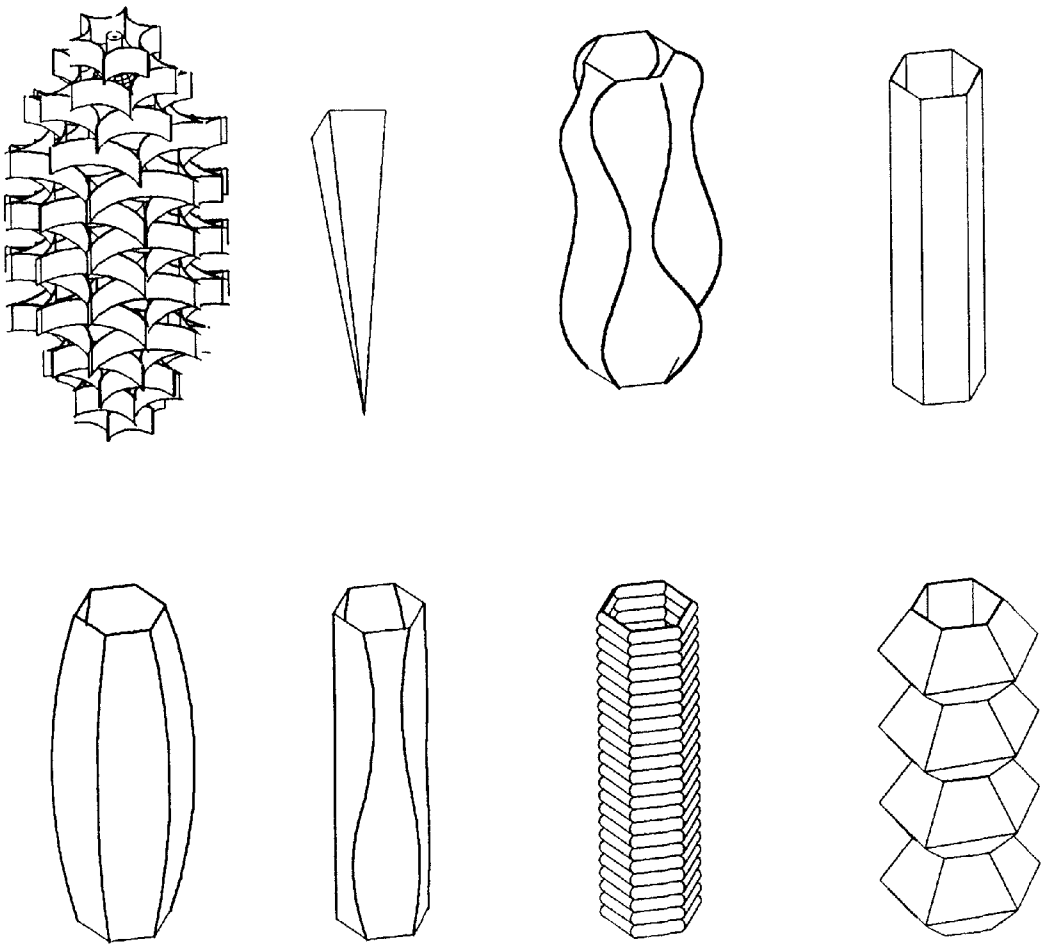
FIG. 14 is an axonometric view of the "Orb" pendant, a ceiling hung embodiment of the invention.

The light tube works quite well as a lamp shade. FIGS. 13–19 show a variety of lamp designs that utilize the light tube in their design. FIG. 13, shows a section and axonometric view of the design for a pendant mounted lamp that has been sold under the name of "Orb Pendant". The tubular body (shade) of the lamp is made out of perforated metal with a fine hole spacing 59. The perforated metal acts as the translucent support surface for the reflective diffraction grating 40, which is applied in strips that are aligned perpendicular to the length of the shade. The perforated metal also creates a pleasing moray effect, as the viewer moves around the lamp. The cross sectional shape of the shade is a polygon, to simplify fabrication. The walls of the shade are curved out from each other to allow the color effects to be seen from a broader vertical viewing angle, as described previously in FIG. 5. The broader viewing angle allow the shade to be placed above the heads of the viewer, and still have the color effects viewable. The light source is a 110 volt spot 60, that can either be incandescent or halogen. Full spectrum bulbs such as those made by Chromalux of France, are good because they have a similar full spectrum light as the sun. The bulb should provide a point light source, and have a clear glass lens, that is not frosted or faceted. The bulb is screw mounted into a standard 110 volt socket 61, that is attached with a support bracket 62, to the shade 59. The entire assembly is hung from a support wire that is housed within the power cord 63, and either swag mounted, or attached directly to a ceiling junction box 64. The same lamp can be made with shades of a variety of other shapes as shown in FIG. 14.

Figure 15:
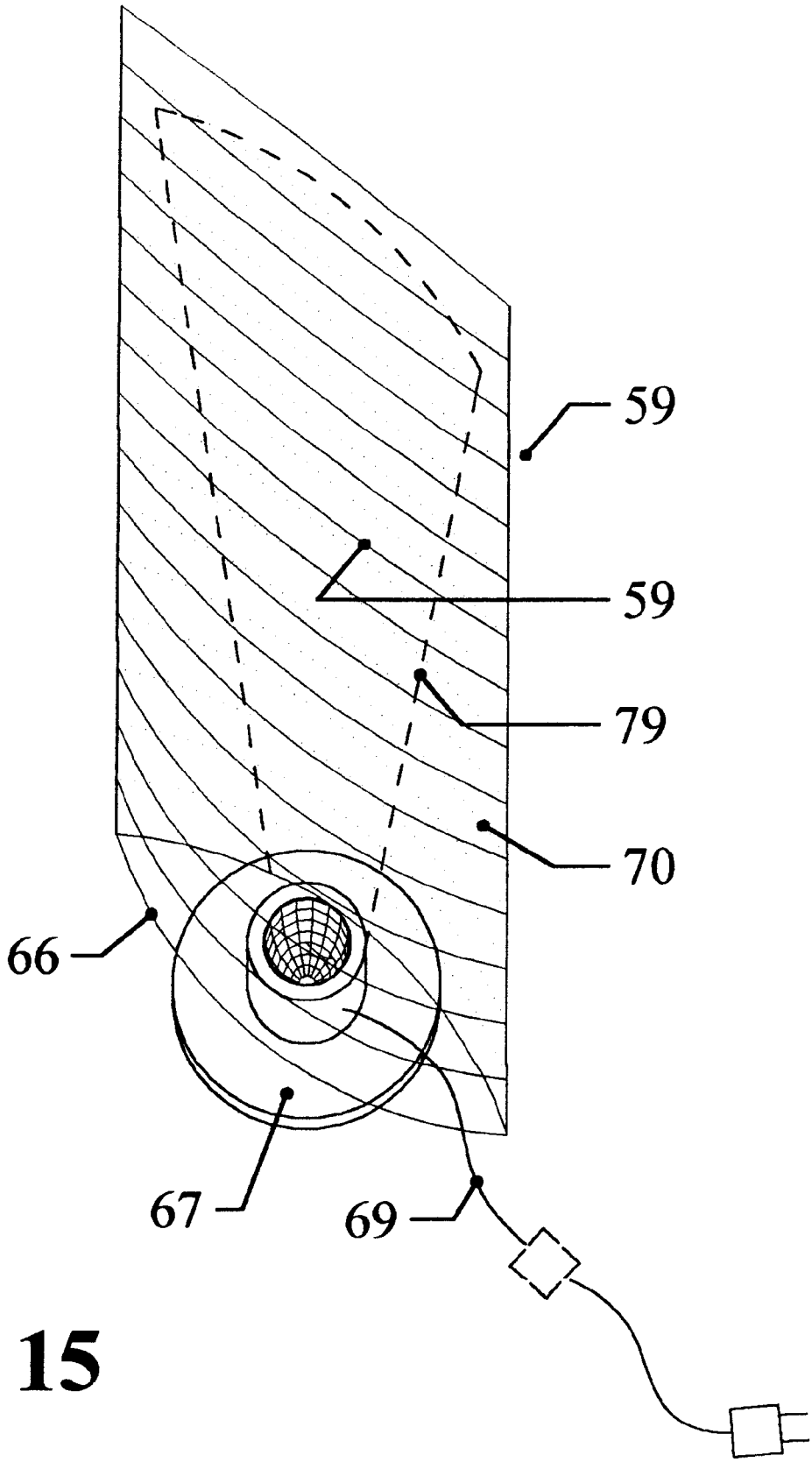
FIG. 15 is a perspective view and of the "Light Pocket", an embodiment of the invention as a table lamp.
Figure 16:
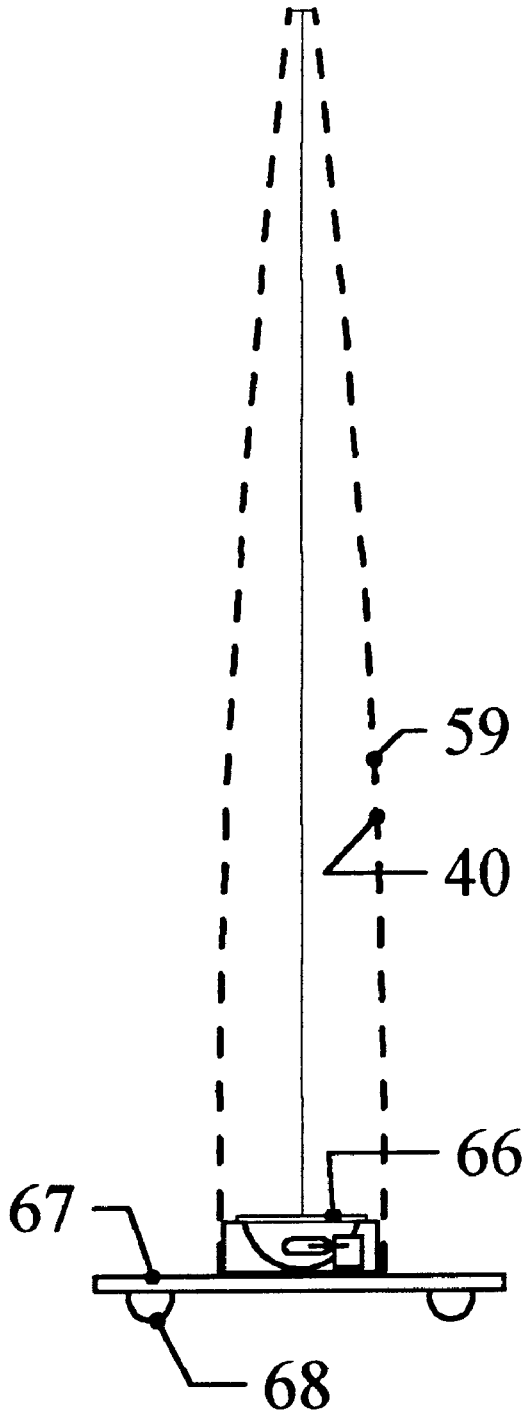
FIG. 16 is a sectional view and of the "Light Pocket", an embodiment of the invention as a table lamp.

FIGS. 15–16, show the light tube adapted to a table lamp called the "Light Pocket". The Light Pocket has a shade made out of the same materials as the Orb Pendant of FIG. 13. The shade is very simple to make because it is made out of two rectangular pieces of the shade material 59, that have been sandwiched together, so that the sides with the gratings are on the inside. The two sheets are spot welded together 70 at the two opposing long sides. One of the short sides 66, is then pulled open so that the assembly resembles a pocket. The open end is then slipped over the light housing 66, to form an oblong shaped tubular grating. The pocket shape of the shade creates an elegant display of colored light 79, that broadens as it reaches the closed end of the pocket. The light housing is made from a 20 watt halogen puck lamp (model # LS1205 made be Lite Source, Inc.) mounted to a metal base 67. The metal walls of the pocket hold themselves to either side of the light housing because they want to spring back to a flat (closed) position.

Figure 17:
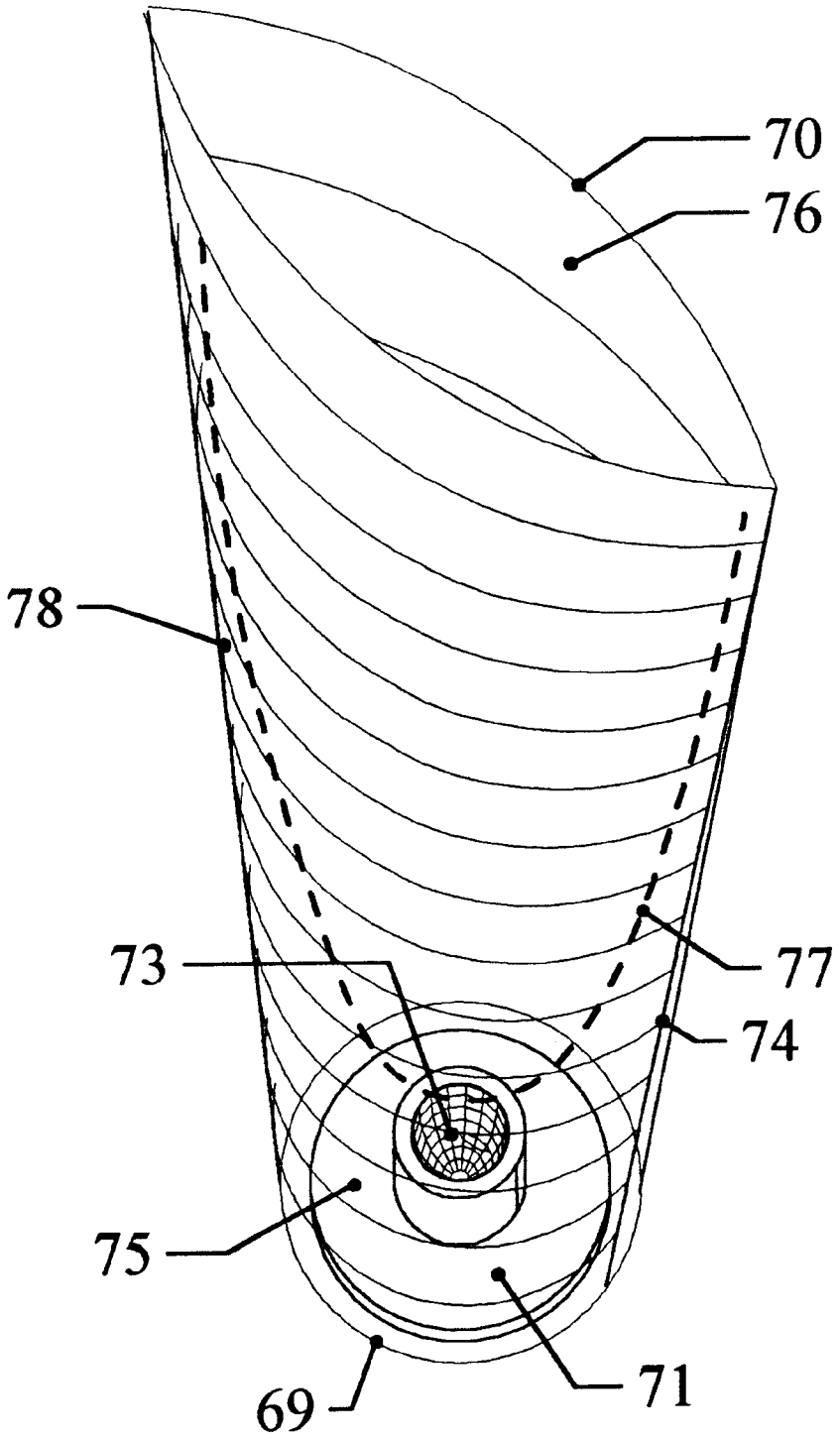
FIG. 17 is a perspective view of the "Light Vase", an embodiment of the invention as a table or floor lamp.

FIG. 17 shows another adaptation of the light tube as a table lamp called the "Light Vase". The Light Vase has a shade made out of the same materials as the Orb Pendant of FIG. 13. The shade material is rolled into a cylinder, and then one of the open ends is pressed flat into an oblong cross sectional shape similar to the Light Pocket. The resulting tube is has a circular cross section at one end 69, and an oval shaped cross section 70, at the other. The light source can either be the same as the light pocket 73, or a 110 volt spot light mounted into a screw type socket that is located at the center of the circular end of the tube. The shade is broad enough to act as the lamp base. The shade creates an elegant display of colored light that broadens with a gentle curve as it reaches its oval end giving the light display the shape of a vase 77.

FIG. 18 shows the design of a more traditionally shaped table or floor lamp that incorporates the tubular diffraction grating into both the lampshade 80, and the base 81, of the lamp. The light source 1, is a 110 volt spot with a standard screw type socket, and is recessed within the top end of the tubular base. The light source is aimed towards the top end of the lamp, where a mirror 49 is supported by the wire framework 82, of the lampshade 80. The lampshade is made out of cloth that has been stretched over a wire frame 82, in a traditional fashion. The cloth is made out of various sheer fabrics that do not diffuse the color effects to the point where they are no longer visible. The translucency of the fabric will effect the intensity of the color display. For this example the fabric is a sheer theatrical scrim sold by Rose Brand Theatrical supplies, Los Angeles, Calif. The reflective Mylar diffraction grating is then laminated to the fabric, and then mounted onto the inside surface of the lamp shade. The base of the lamp 81, can be made out of metal and be either completely or partially coated with a reflective grating 86, in the same manner as the light rod. Light from the light source 4, hits the top portion of the lamp shade and the mirror, which reflects the remaining light 83, back towards the floor, and the lower portion of the lampshade. The light that is hitting the lower portion of the shade is then reflected back 84, towards the lamp base by the reflective grating. With this configuration the top third of the lamp shade has an intense color display, the lower two thirds is more diffuse, and the exposed grating 86, on the base displays a subtle iridescence. The mirror is useful because it directs light back to the floor or tabletop 87, so this configuration makes a good task light.

Figure 19:
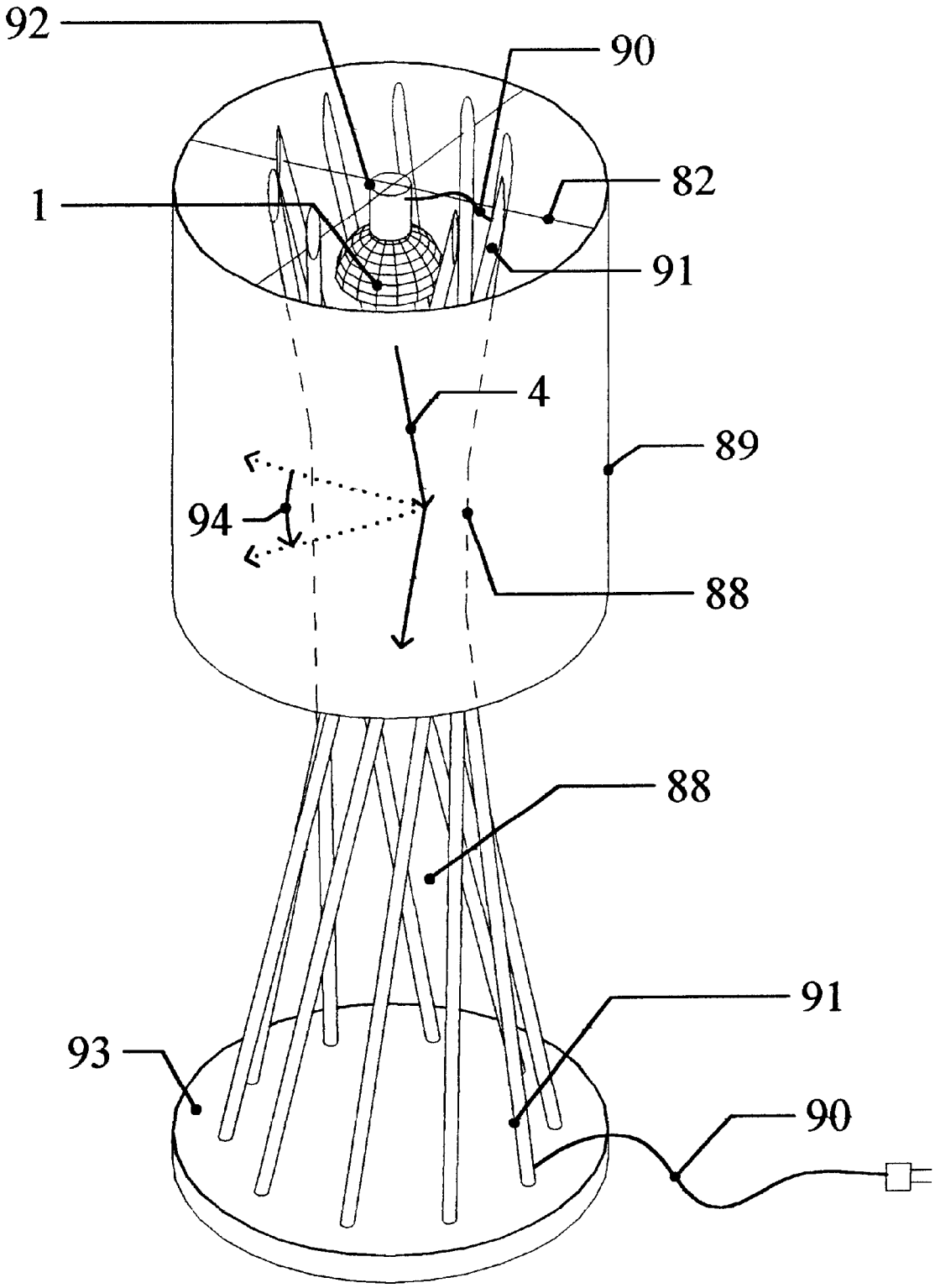
FIG. 19 is a perspective view and sectional view of an embodiment of the invention as a traditional table or floor lamp using a tube made out of light rods.

FIG. 19 shows a variation of the lamp described in FIG. 18 that has the spot light source 1, located at the top of the lamp shade and aimed towards the floor. The lamp body is made out of a tubular array of light rods 88, that are shaped into a graceful helix. The shade is made out of sheer cloth 89, with no diffractive Mylar attached to it, stretched over a wire frame 82. The color display created from the tubular array of light rods 94, transmits through the translucent fabric, and is also displayed along the length of the exposed light rods below. The lamp housing 92, is designed to lift out of the helix for re-lamping. The power cord 90, is concealed within one of the light rods 91. The light rods 88, are attached to a base 93, made out of polished black granite or another material with a dark reflective surface that will reflect the rods and their color display. The lamp can be sized into either a floor or table lamp.

Figure 20:
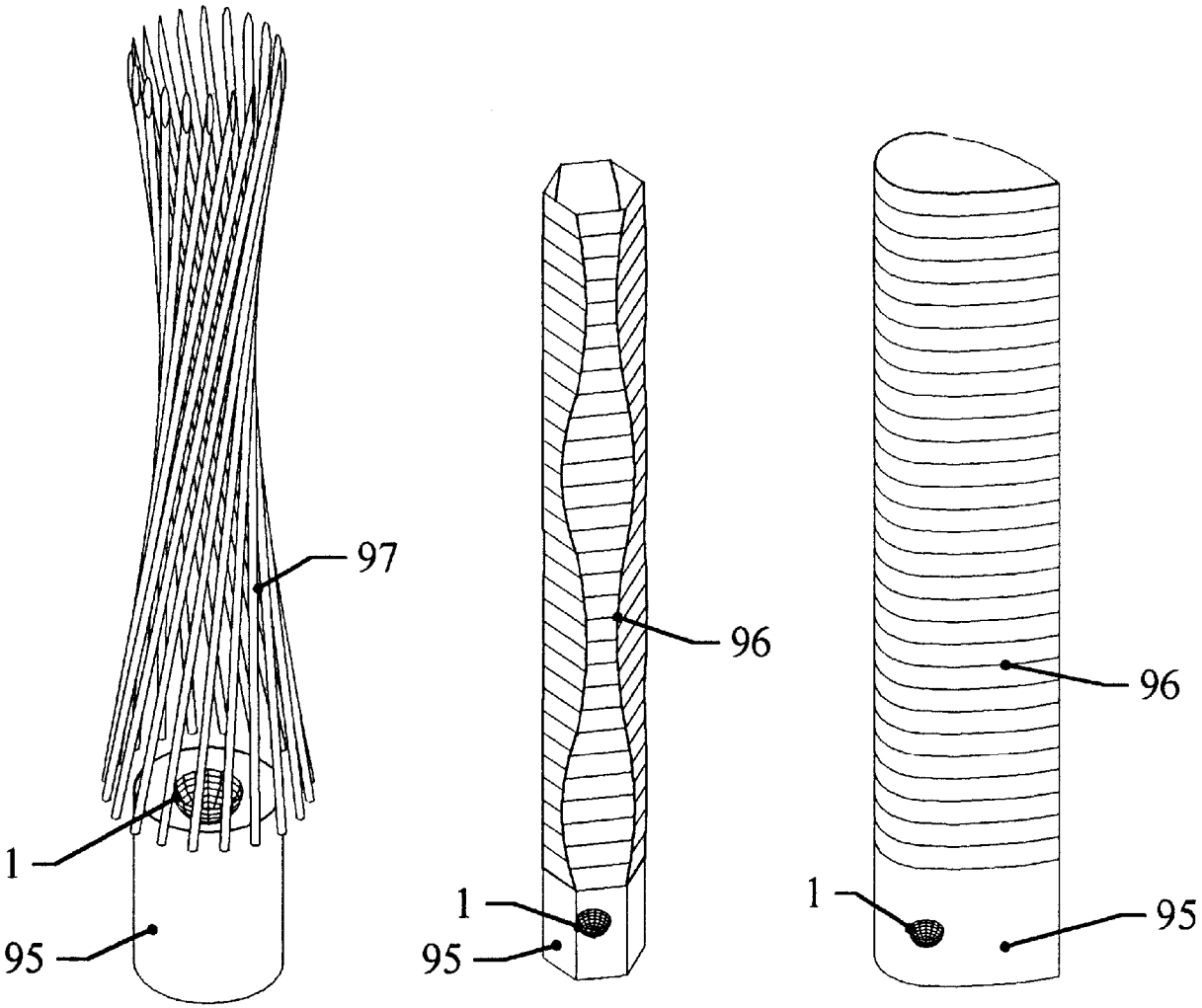
FIG. 20 is a group of 3 axonometric views of light tubes as floor lamps.

The light tube can be designed as a floor lamp as shown in the designs pictured in FIG. 20. where the light source 1, is located in a metal base 95, that supports the tubular shade 96, of the lamp. The light source is a 110 volt spot with a screw mount. The base is designed so that the sides of the base baffle the light source, so it is not visible to the observer. The shade can be made out of a variety of materials and shapes as described previously. One option has the shade made out of an array of light rods formed into a helix 97.

Figure 21B:
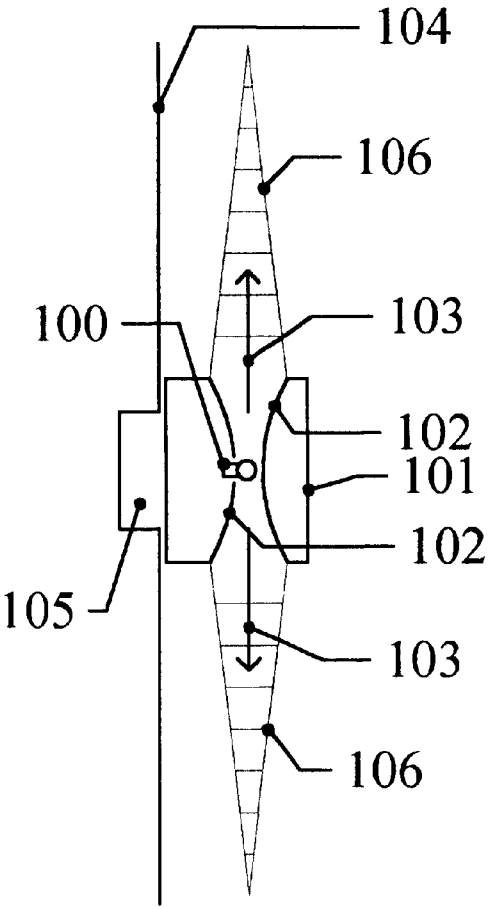
FIG. 21B is a sectional view of the light tubes used in a wall sconce.
Figure 21A:
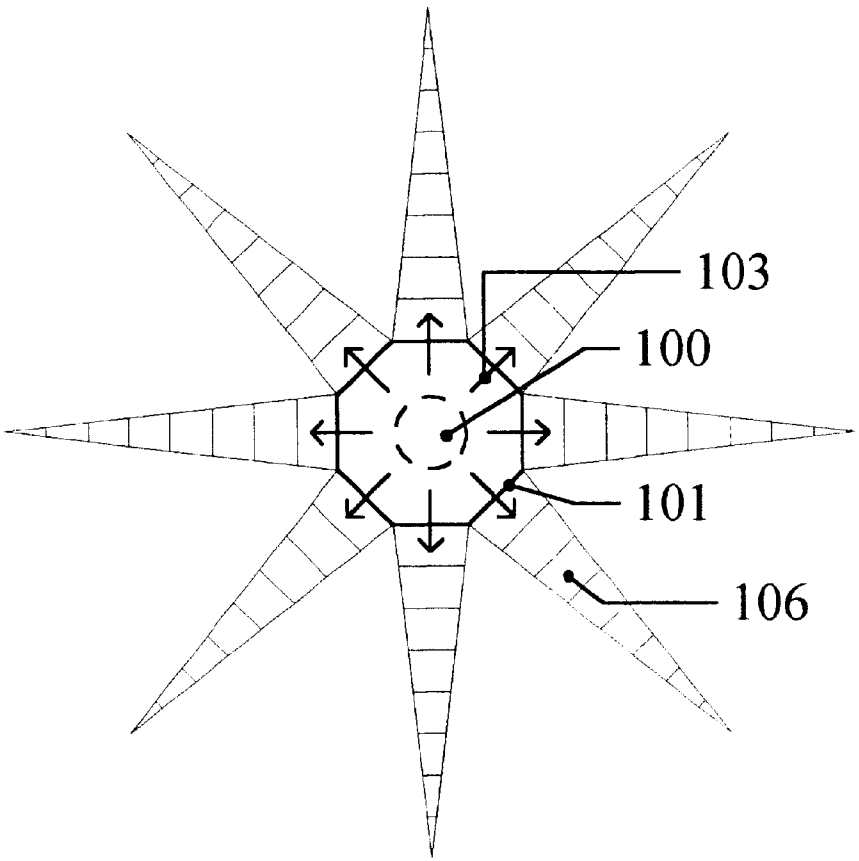
FIG. 21A is an elevational view of the light tubes used in a wall sconce.

A circular array of light tubes can be made into a sconce with a sunburst motif, as shown in FIG. 21A (elevational view) and 21B (sectional view). The sconce utilizes the light distribution scheme described in FIG. 12, and uses a clear incandescent bulb 100, that does not have a reflector. The bulb should be clear, so that the light source remains a point source and is not diffused by frosted glass. A bi pin 110 volt 50 watt halogen works the best. The light bulb is mounted in the center of circular, or polygonal light housing 101. A on the top and bottom of the bulb, a pair of convex reflectors 102, made out of highly polished aluminum are mounted to focus the light rays into a radial pattern that aligns with the open ends of the light tubes 103. The light housing not only acts as a point of attachment for the light tubes, but it baffles the light source from being seen by the observer. The rear of the light housing is mounted to the wall 104, and a recessed electrical junction box 105. The light tubes can be made out of any of the materials described previously, and can be shaped into cones 106, to resemble the rays of the sun.

Figure 22:
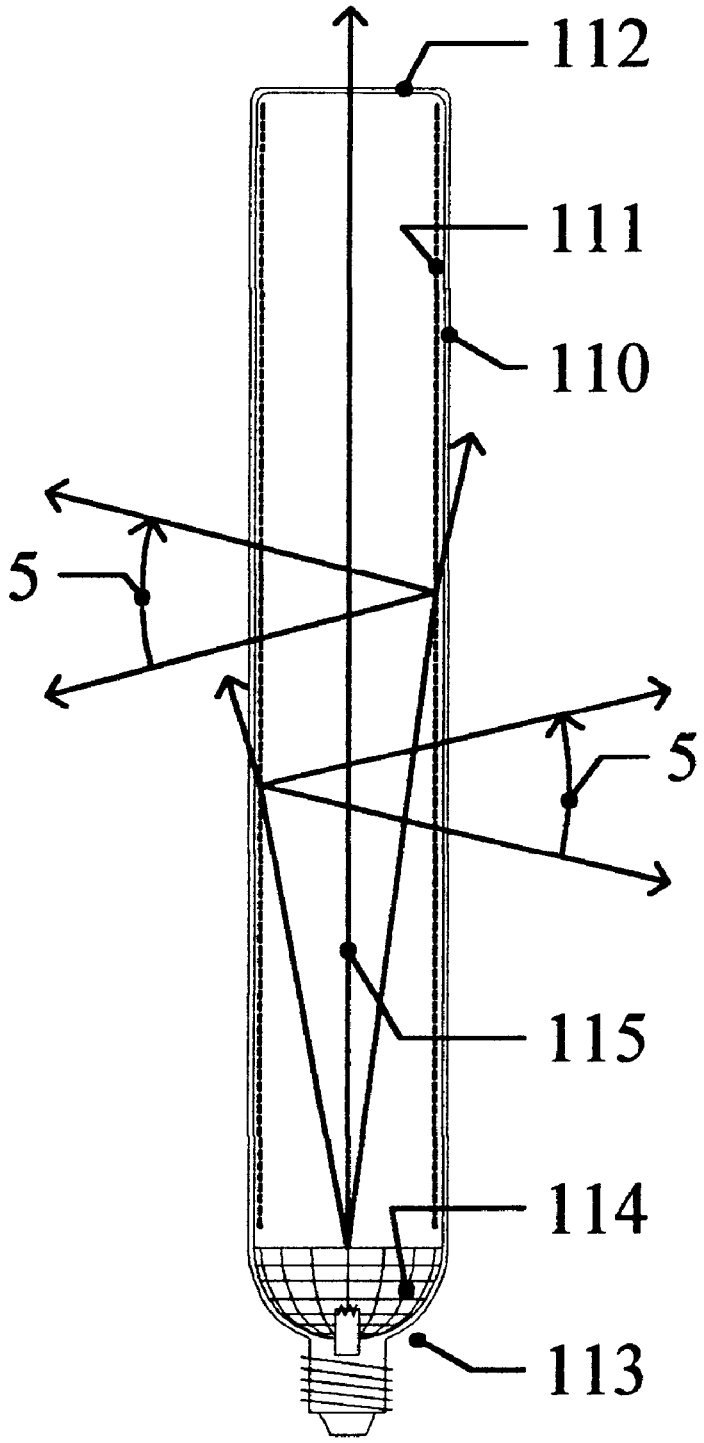
FIG. 22 is a diagrammatic section describing the use of the light tube within the structure of a light bulb.

The light tube concept has its purest expression as a transmissive grating molded into the surface of a glass cylinder 110. This cylinder can be sold as an accessory that can be placed over a light source and used in a similar fashion as a lantern glass, or it can be used within the sealed structure of a light bulb, as shown in FIG. 22. The light bulb consist of a glass cylinder 110, with the tubular grating molded into its surface 111, that can be made into lengths to fit particular applications, in a similar manner to way that fluorescent tubes are sized. One end of the tube is sealed shut 112, and at the opposite end a mr16 or mr11 halogen light housing 113, is mounted with its reflector 114, aimed through the center of the tube 115.

Figure 23:
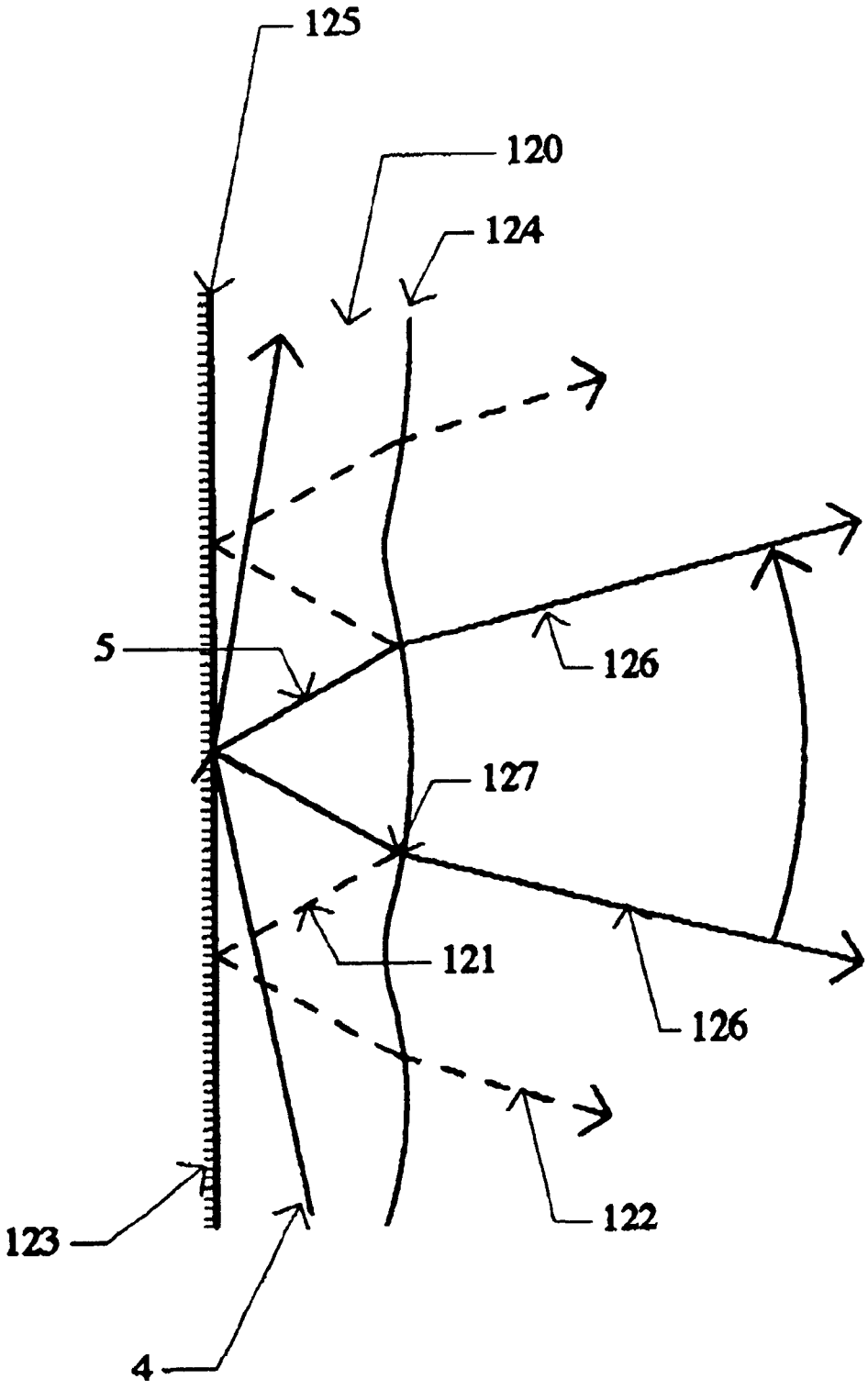
FIGS. 23–24 are diagrammatic sections describing the principles behind the use of running water over the surface of the diffraction grating.

FIG. 23 describes the effects of using a liquid as the body of a light tube. It has been discovered that the body of a clear liquid 120, can act in a similar way to the light tube, if the set of opposing surfaces of the water body 124, 125, can be directed to be approximately parallel to each other along the axis of the light source 4. Along this axis a reflective diffraction grating 123, is positioned within, or can act as a containing surface to the water body. Due to the properties of refraction, the surface of the water opposite to the grating surface 124, simultaneously transmits 126, and reflects 121, the diffracted light rays 5. This effect creates sets of overlapping light rays 126, 122. The overlapping light rays enhance the effect that the color field is not emanating from the surface of the grating, but gives a 3 dimensional depth to the display and makes it appear as if it is suspended within the center of the water. Refraction also causes the transmitted light rays to be bent from their original axis. Any movement of the liquid surface creates variations to the refraction angle with a resulting shift 127 to the color display.

Figure 24:
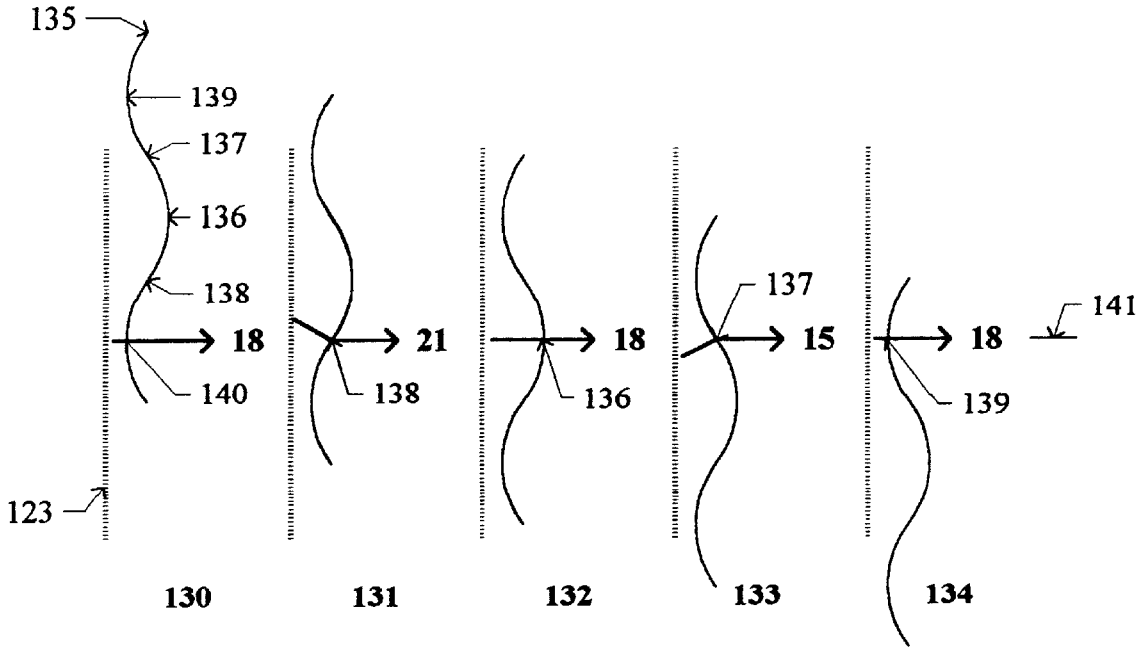

FIG. 24, describes the effect that the surface of a moving liquid opposite to the diffraction grating, has on the color display. The effect is described with 5 sequential diagrams 130–134, that trace the movement of a wave of liquid over a diffraction surface. In the diagrams the liquid surface is shown as a wave 135, with one ridge 136, two opposing slopes 137–138, and two valleys 139–140. For clarity, the diagrams show diffracted light that is viewed in a perpendicular axis 141, to the diffraction surface 123. In diagram 130, the wave is positioned so that the center of the first trough 140, is aligned with the viewing axis 141. Since the surface of the liquid 135, is perpendicular to the viewing axis 141, there is no color shift caused by refraction, and the resulting color is green 18. In diagram 131, the wave is positioned so that the center of the first slope 138, is aligned with the viewing axis 141. Since the surface of the liquid 135, is sloped to the viewing axis 141, there is a color shift caused by refraction, and the resulting color is red 21. In diagram 132, the wave is positioned so that the center of the ridge 136, is aligned with the viewing axis 141. Since the surface of the liquid 135, is perpendicular to the viewing axis 141, there is no color shift caused by refraction, and the resulting color is green 18. In diagram 133, the wave is positioned so that the center of the second slope 137, is aligned with the viewing axis 141. Since the surface of the liquid 135, is sloped to the viewing axis 141, there is a color shift caused by refraction, and the resulting color is violet 15. In diagram 134, the wave is positioned so that the center of the last trough 140, is aligned with the viewing axis 141. Since the surface of the liquid 135, is perpendicular to the viewing axis 141, there is no color shift caused by refraction, and the resulting color is green 18.

Figure 25:
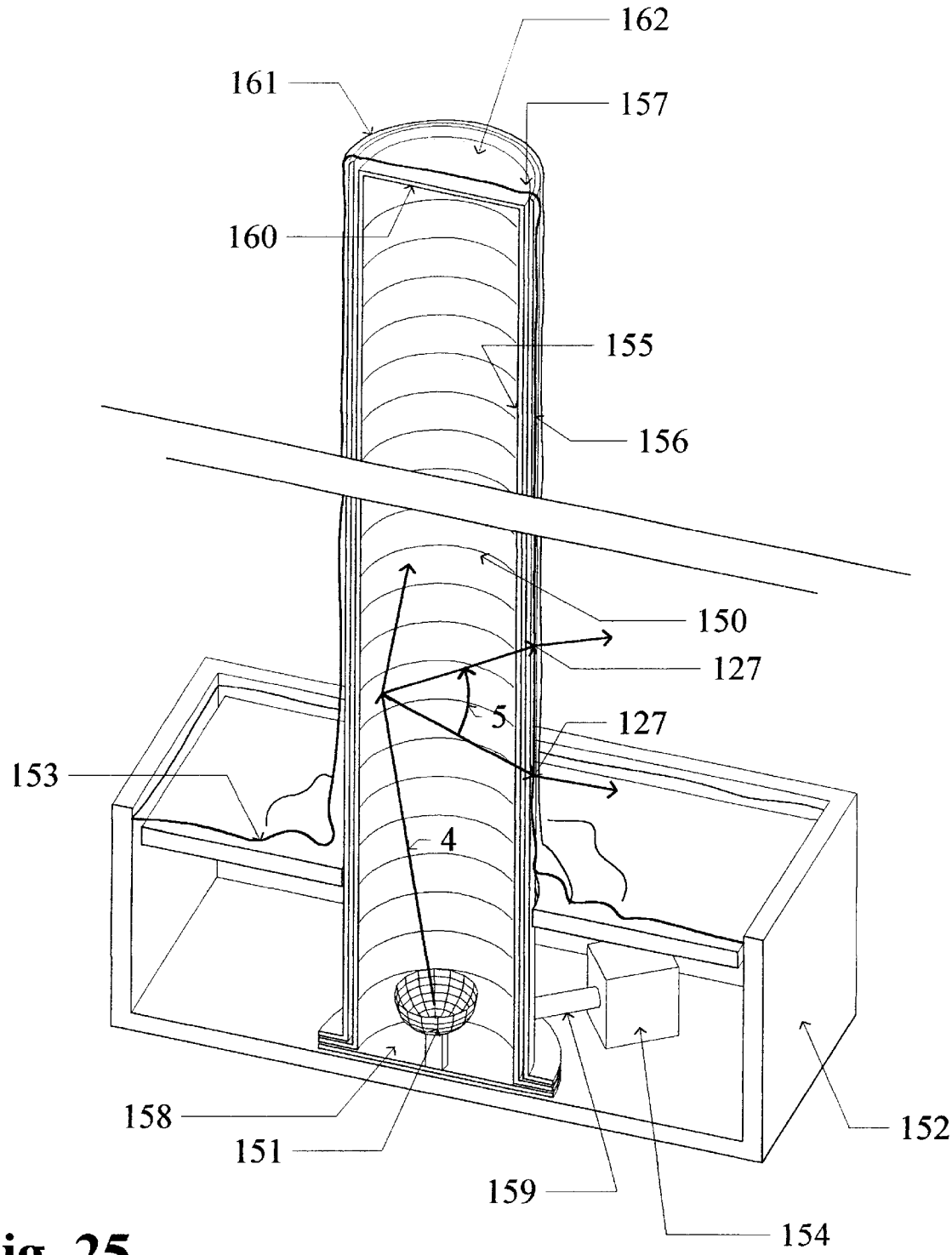
FIG. 25 is a section axonometric describing an embodiment of the spectral light tube used as a fountain.

The color effects created with the liquid light tube are quite pleasing and effective when incorporated into the design of fountains. FIG. 25, shows a fountain that consist of a tubular light body made out of either clear glass or plastic 150, with a spot light source 151, set inside the bottom end and directed through the center of the tube. The tubular light body is set into a water basin, so that the water level 153 is above the top of the light source 151. The tubular light body consist of an inner 155, and outer tube 156 that are telescoped inside of each other so that there is a consistently spaced gap between them 157. The bottom end of the tube is sealed with a water tight cover 158, that can be removed for maintenance. Water is pumped with a submersible pump 154, through a tube 159, into the gap between the inner and outer tubes where it can flow to the top of the tubular assembly. A clear water tight lid 160, is placed on the top of the inner tube, which is about ¼ shorter than the top edge of the outer tube 156. This configuration creates a small basin 162, for the water to collect as it is pumped through the gap between the tubes. As water fills the basin 162, it flows over the top edge of the outer tube, and cascades down the outer surface of the tube. The top edge 161, of the tube acts as a weir, so the outer corner of the edge must be rounded to produce an even cascade of water. The top edge must also be level, and the tube must also be vertical for an even flow of water down its surface. The refraction of light through the surface of the cascade of water 127, creates a dynamic effect. The diffraction grating can either be reflective or transmissive. The reflective grating produces a display that is clearer and is more kinetic than the transmissive grating, but the structure of the transmissive grating disappears into the water, which makes the color display appear to be coming from the water itself.

Figure 26:
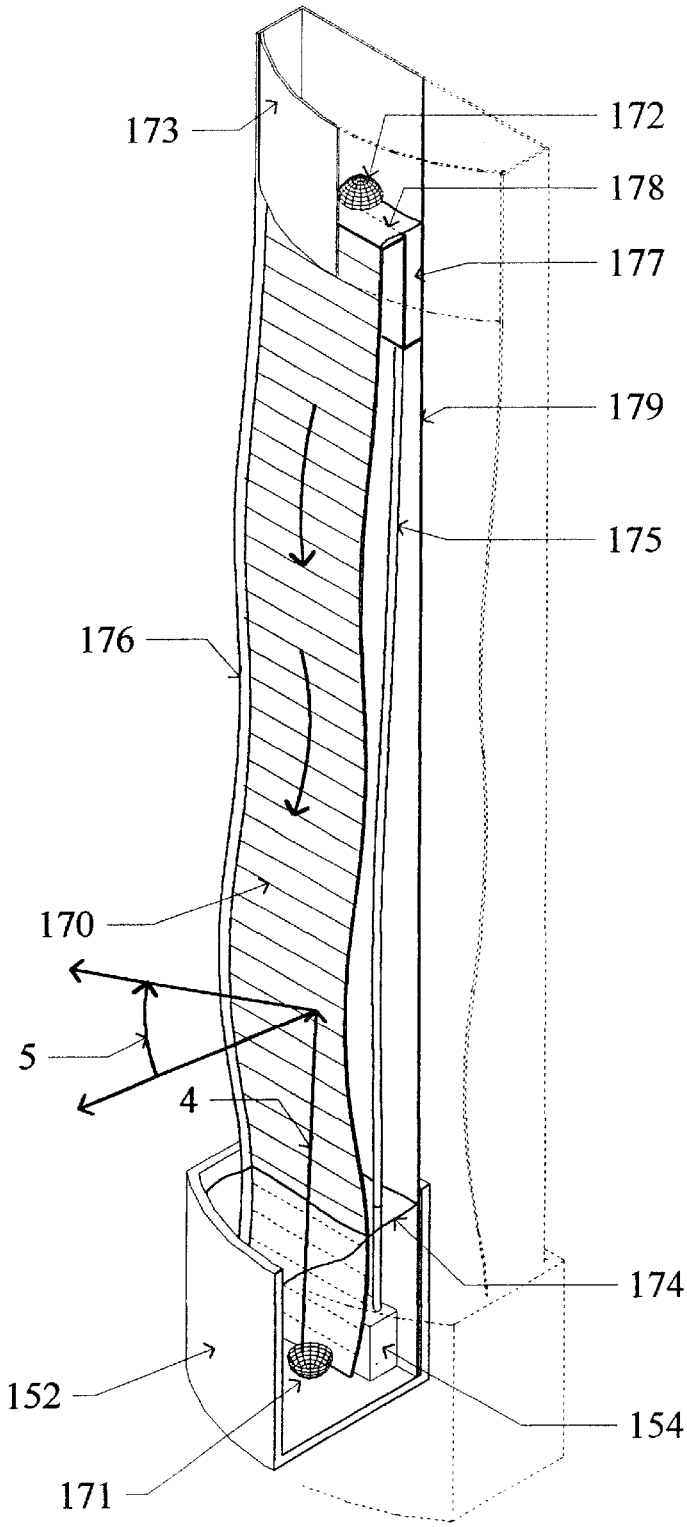
FIG. 26 is a section axonometric describing an diffraction grating used in an illuminated water wall type fountain.
Figure 27:
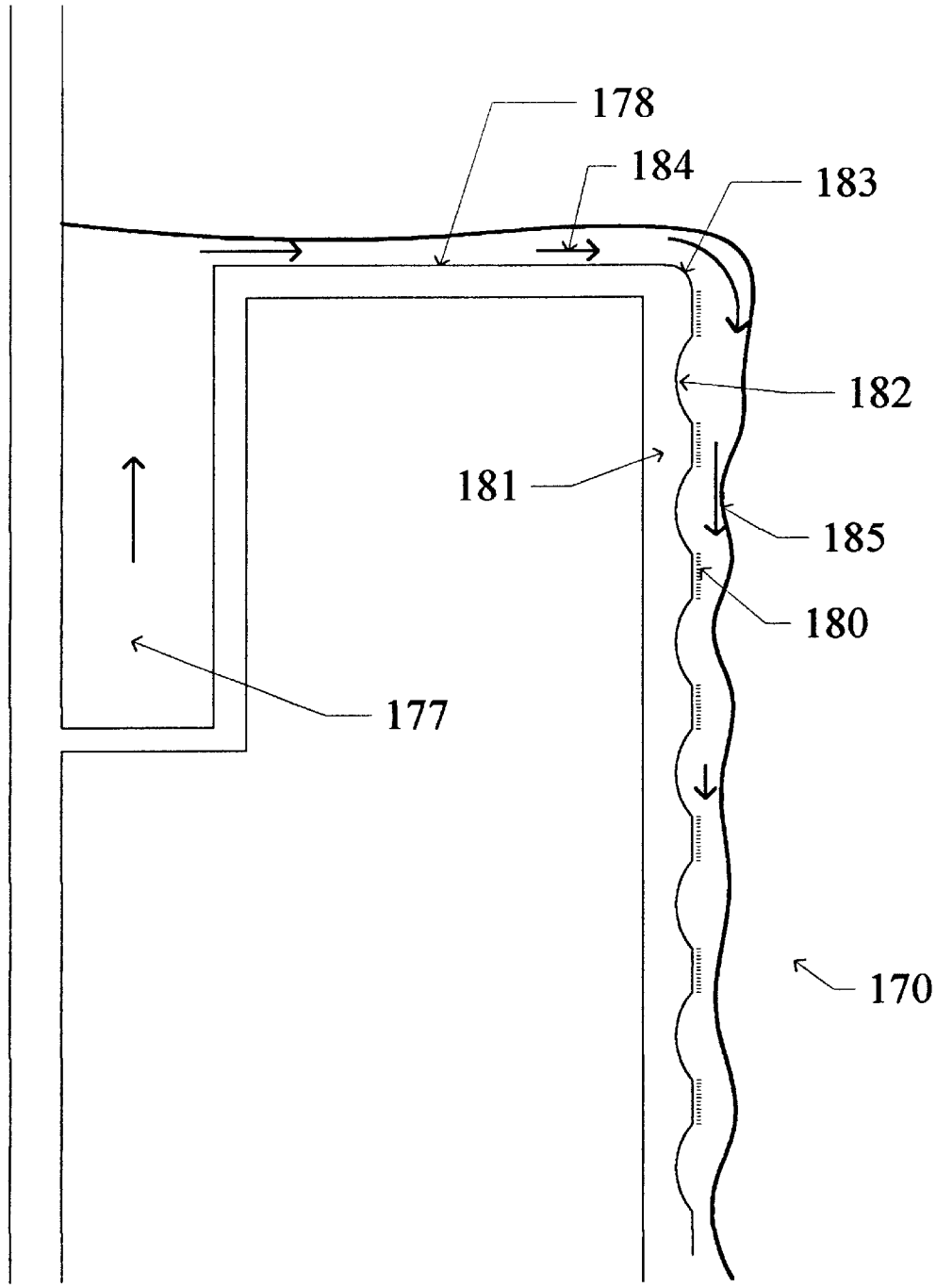
FIG. 27 is a detailed section of the weir and face of the water wall type fountain.

FIGS. 26–27, illustrate the design of a water wall type of fountain that incorporates a diffraction surface. The fountain consist of a vertical face 170, (described with detail in FIG. 27) that has a ribbed surface, with horizontal strips of the reflective diffraction Mylar 180 applied to the ridges of the ribs 181, which have a flat surface. The valleys of the ribs 182, are curved and are colored black to accentuate the ridges with the diffraction grating applied to them. The vertical face 170 is made out of black plastic, and attached to a vertical side panel 176, at each side, that are then attached to a rear panel 179. The vertical face 170, can be straight or be molded with a subtle wave in its profile as shown in this example. The wave creates variety to the color display as previously described in FIGS. 5, 6. This assembly is set into the rear side of a water basin 152, made out of heavy black plastic, so that the vertical face 170, faces the front of the basin. In the front of the basin, centered with the vertical face 170, is located a 20 watt halogen underwater lamp 171, aimed towards the top of the vertical face, at an oblique angle to the diffraction surface 180. A submersible pump 154, is located at the rear of the basin 152, so that it is concealed by the cavity created by the vertical face, side and rear walls. The pump delivers water 185, through a vertical tube 175, to a small reservoir 177, at the top edge of the vertical face 170. The top of the reservoir and vertical face are connected by a horizontal weir surface 178, that helps smooth out the water flow 184, before it reaches the weir edge 183, where it cascades down the vertical face 170. For the color effects to work best the water flow must be a laminar flow that is adhered directly to the vertical face. The weir surface helps insure this because it helps to remove disruptive turbulence from the water flow. The surface of the of the vertical face is molded into a profile with horizontal ridges 181, and valleys 182, that distribute the laminar flow of water evenly over the width of the vertical face throughout the entire vertical fall. The ribs also cause the outer surface of the water 185, to curve outward from the flat face of the diffraction surface. The refractive quality of water's curved surface acts as a lens and magnifies the color effect. The valleys made out of black plastic provide a visual contrast to the bright display of the ridges, and enhances the effect. The edge between the diffractive ridges and black valleys is where fluctuations in the color display due to fluctuations in the thickness of the water become the most pronounced. This is because when the water layer is thin, there is less room for the diffracted light rays to bounce around inside of it, so they do not carry over very far into the portion over black valley, and the perceived width of the diffraction strip is about the same as its actual width. When the water layer is thick, the diffracted light rays spill over into the black portion so that the perceived width of the diffraction strip is magnified. As the strip is magnified there is also a subtle shift in the color display. As the water falls down the vertical face 170, it forms a wave pattern of various water thickness. The wave pattern is then highlighted by the color shift created by the change in water thickness.

Figure 28:
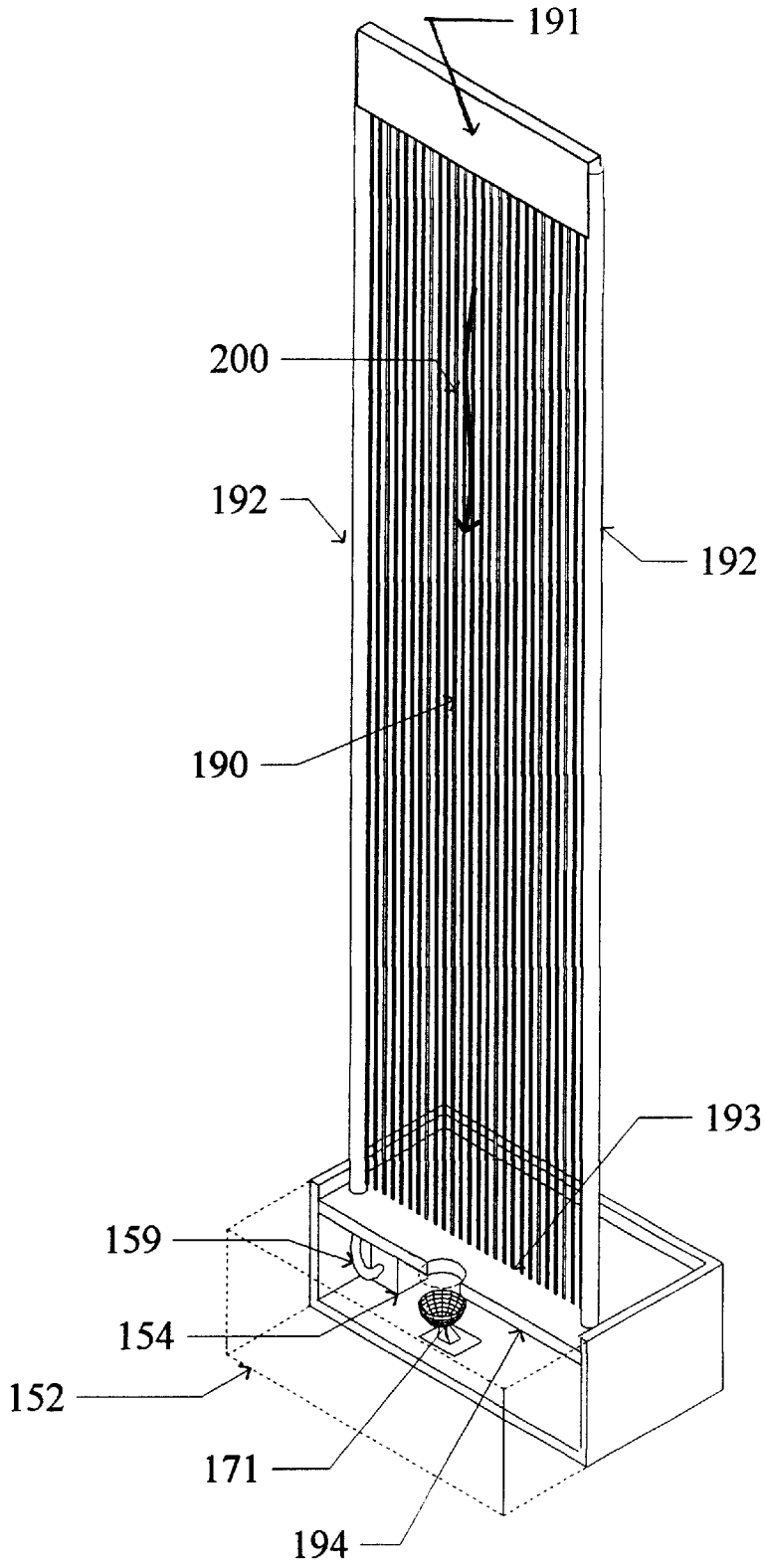
FIG. 28 is a section axonometric describing an diffraction grating used in an illuminated rain type fountain.

FIG. 28, shows another embodiment of a fountain utilizing a diffraction grating in a series of vertical strips 190, that have water 200, flowing down their surface. The strips can either be fashioned by laminating two strips of diffraction Mylar film together, or by winding the diffraction Mylar film around mono-filament nylon fishing line. The laminated Mylar strips have the advantage of economy, but the color display is primarily visible from the flat sides of the strip. The water does increase the viewing angle because its curved surface acts like a wide angle lens. The fishing line approach creates a miniature version of the light rods, so the color effects are visible from any angle.

Figure 29:
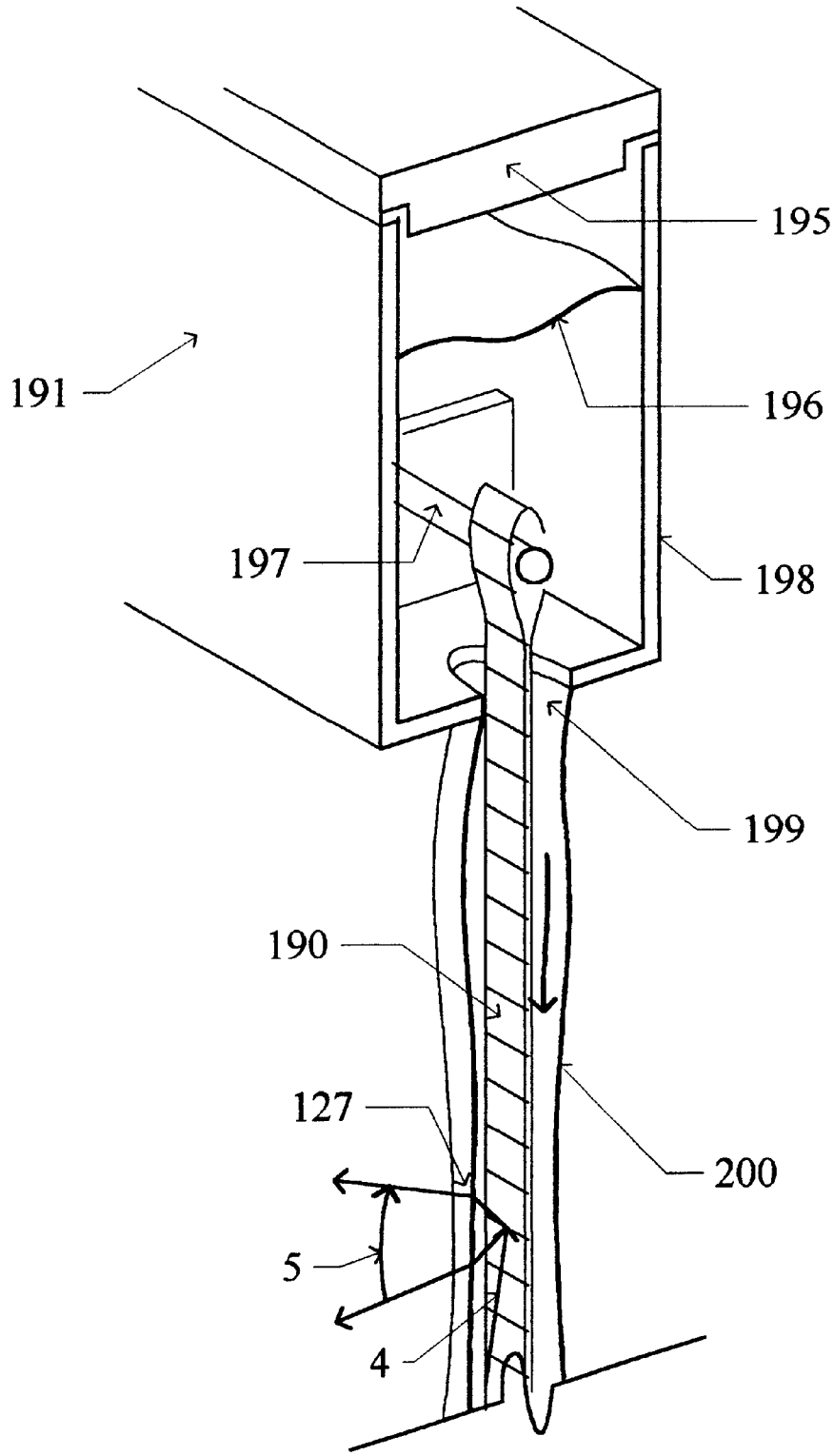
FIG. 29 is a detailed section of the weir and face of the rain type fountain.

The fountain has a water basin 152, that is deep enough to conceal a submersible pump 154, and an underwater spot light 171. A tubular framework 192, is attached to a cover plate 194, that is placed into the basin so that the top edge of the cover plate is positioned just below the water line. There are holes in the cover plate that are aligned with the underwater spot lights to allow the light to pass through and baffle the light source. The cover plate acts to hide the pump and light housings. The tubular framework is hollow, and is attached to the submersible pump with a small hose 159. Water is pumped into the framework to the top of the assembly into a small reservoir 191, that connects the two vertical tubes together. FIG. 29 is a detailed view of the reservoir, which has a series of holes 199, in its bottom edge. The diffraction strips 190, are strung through the holes, and positioned so that they are centered with each hole. The top of each strip 190, is tied around a horizontal support pin 197, that is suspended inside of the basin. The bottom of each strip is tied around another support pin 193, that is attached to the cover plate at the water basin below. The strips suspend the cover plate inside of the basin, so they are kept in constant tension which is necessary for the water to flow properly. Water flows through the holes at the bottom of the reservoir onto the surface of each strip, and down to the basin below. The flow of water is regulated so that there is enough to cover each strip without any splashing. The spot lights from below illuminate the strips of reflective diffraction grating at an oblique angle, so they project a dynamic display of diffracted light. The display is very effective because the colored light produced by the strips is visible, and not the strips within the water flow. The colors appear to come from the water flow itself.

Figure 30:
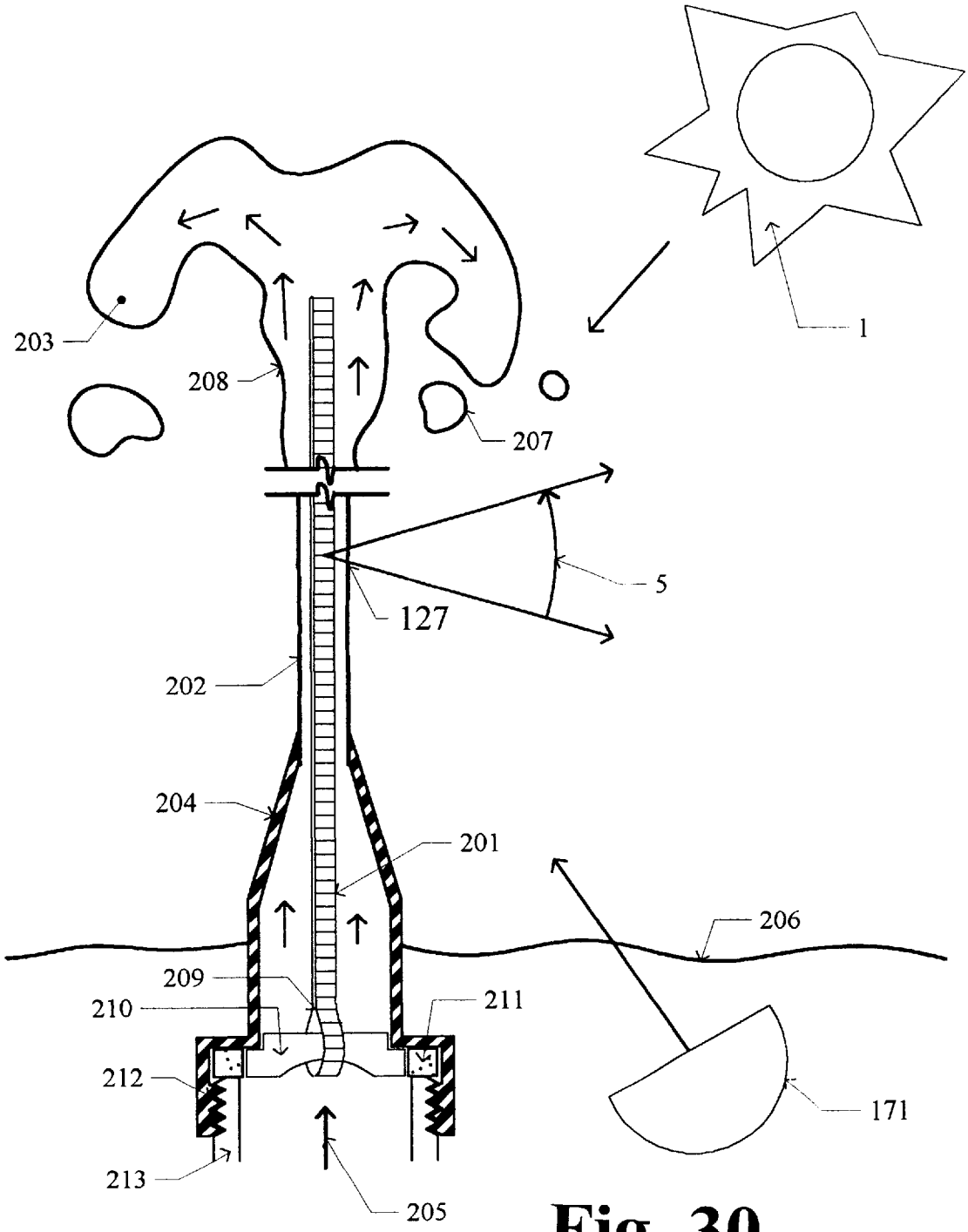
FIG. 30 is a detailed section of a diffraction grating used within the nozzle of a fountain.

FIG. 30 shows an embodiment of a fountain utilizing the diffraction strips 201, placed inside of a jet of water 202. The diffraction strip 201, can be made in a similar way to the previous embodiment, but with a loop 209, at only one end. Inside of a water nozzle 204, a removable support pin 210, designed to slide within the back side of the nozzle 204, is placed through the loop 209. The support pin holds the diffraction strip so that it is centered within the nozzle and the water flow 202. The nozzle and support pin are removable for cleaning and maintenance. The assembly has a female threaded connection 212, with a washer 211, so that it can be screwed to the male thread of a pipe 213, or hose. The diffraction strip should not be any longer than the length or height of the water jet. The strip can stay suspended within the water jet 202, as long as the end of the strip is below the turbulent crown 203, of the spray. The water jet can be turned off and on because the strip is light enough to suspend itself inside of the jet, as long as there is nothing in the basin for it to snag on. The color display is uniform at the base of the jet, and gets more varied and dynamic as the turbulence of the water increases towards the top of the spray. This embodiment is highly effective in outdoor fountains because the sun 1, makes an excellent light source. Underwater lights 171, can be used to illuminate the display at night and during cloudy days.

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

What is claimed is:

1. A lighting system including a tube having a length with its walls consisting at least partially of a first diffraction grating having a ruled surface, with its ruled surface aligned perpendicular to the length of the tube to disperse a field of rainbow colored light when illuminated with a light source aimed through or along the length of the tube.

2. The lighting system of claim 1, wherein the field of rainbow light is enhanced by overlapping light rays created by the simultaneous dispersion of light from diffraction means on opposite walls of the tube.

3. The lighting system of claim 1 wherein the cross sectional shape of the tube is a polygon.

4. The lighting system of claim 1 wherein the cross sectional shape of the tube is oblong or asymmetrical.

5. The lighting system of claim 1 wherein the tube is made out of a transparent or translucent material partially covered with a second, reflective diffraction grating oriented in the same manner as the first diffraction grating.

6. The lighting system of claim 1 where the tube is made out of an opaque material covered completely with a second, reflective diffraction grating oriented in the same manner as the first diffraction grating and the tube has a series of perforations in its surface to allow the colored light produced from within to be visible.

7. The lighting system of claim 1 where the tube is made out of a strips of either a reflective or transmissive second diffraction grating woven together to form the shell of the tube, and oriented in the same manner as the first diffraction grating.

8. The lighting system of claim 1 where a reflective second diffraction grating may be mounted or molded into the surface of any material that is then assembled as a piece to an aggregate tubular structure and oriented in the same manner as the first diffraction grating and light is allowed to pass through the open gaps between the pieces.

9. The lighting system of claim 1 wherein there are multiple light sources.

10. The lighting system of claim 1 wherein there are mirrors used to reflect the light source and act as a light source.

11. The lighting system of claim 1 wherein there are multiple light tubes arrayed around a single light source.

12. The lighting system of claim 1 wherein the tube is used as a lampshade.

13. The lighting system in claim 1 used for navigation.

14. The lighting system in claim 1 used as a decorative light source.

15. The lighting system in claim 1 used for signage.

16. The lighting system in claim 1, wherein the light source is the sun.

17. The lighting system in claim 1 wherein the cross sectional shape of the tube is a circle.

18. The lighting system of claim 1 used for sculpture.

19. The lighting system of claim 1 where the walls of the tube are not parallel to each other.

20. The lighting system of claim 1 where the walls are designed to have a transparent fluid such as water pass over them that causes the field of colored light to fluctuate with the pulse of the flowing liquid.

21. The lighting system of claim 1 wherein the tube is made of a clear material wherein the grooves of the diffraction grating are etched, ruled or scribed into its surface.

22. The lighting system of claim 21 wherein the tube is part of the structure of a light bulb.

23. A fountain with a surface designed to have a liquid flow over it wherein that surface is a diffraction grating or is coated with a diffraction grating.

24. The fountain of claim 21, wherein the field of rainbow light is enhanced by overlapping light rays created by the simultaneous dispersion and refraction of light rays from diffraction means and the opposite surface of the flowing liquid.

25. The fountain of claim 23 wherein the diffraction grating is reflective.

26. The fountain of claim 23 wherein the diffraction grating is transmissive.

27. The fountain of claim 23 wherein there is either a single or multiple light sources that illuminates the diffraction grating from an oblique angle to create colored light that appears to emanate from the water flow.

28. The fountain of claim 23 wherein the light source is the sun.

29. The fountain of claim 23 wherein the surface is vertical or almost so.

30. The fountain of claim 23 wherein the surface has horizontal ridges, similar to a washboard to smooth the water flow.

31. The fountain of claim 30 wherein the diffraction grating is only located on the peaks of the horizontal ridges.

32. The fountain of claim 21 wherein the surface is only partially coated with the diffraction grating.

33. The fountain of claim 23 wherein the surface comprises ribbons of diffractive Mylar spaced so that the liquid flows over the front and back surface of each.

34. The fountain of claim 23 wherein the surface is curved.

35. The fountain of claim 23 wherein the surface is a cylindrical tube, and the liquid flows down the length of the tube.

36. The fountain of claim 23 consisting of a water nozzle that suspends a ribbon of diffractive Mylar in the center of the water flow to fill its length with rainbow light.

37. A lighting system comprising:

a light source; and a diffraction grating, wherein colored light is produced by the diffraction grating, the colored light being used for decorative purposes, for signage, or for highly visible ways of marking things for navigation, industry and safety.

* * * * *